US009908361B2

(12) United States Patent
Schaede et al.

(10) Patent No.: US 9,908,361 B2
(45) Date of Patent: Mar. 6, 2018

(54) PRINTED SECURITY FEATURE, OBJECT COMPRISING SUCH A PRINTED SECURITY FEATURE, AND PROCESS OF PRODUCING THE SAME

(71) Applicant: KBA-NOTASYS SA, Lausanne (CH)

(72) Inventors: Johannes Georg Schaede, Würzburg (DE); Alexander Fellmann, Zurich (CH)

(73) Assignee: KBA-NotaSys SA, Lausanne (CH)

( * ) Notice: Subject to any disclaimer, the term of this patent is extended or adjusted under 35 U.S.C. 154(b) by 265 days.

(21) Appl. No.: 14/890,346

(22) PCT Filed: May 13, 2014

(86) PCT No.: PCT/IB2014/061406

§ 371 (c)(1),
(2) Date: Nov. 10, 2015

(87) PCT Pub. No.: WO2014/184739

PCT Pub. Date: Nov. 20, 2014

(65) Prior Publication Data

US 2016/0121639 A1 May 5, 2016

(30) Foreign Application Priority Data

May 13, 2013 (EP) ..... 13167568
Aug. 7, 2013 (EP) ..... 13179654

(51) Int. Cl.
*B42D 25/387* (2014.01)
*B42D 25/00* (2014.01)
(Continued)

(52) U.S. Cl.
CPC ..... *B42D 25/387* (2014.10); *B41M 3/144* (2013.01); *B42D 25/29* (2014.10); *B42D 25/30* (2014.10);
(Continued)

(58) Field of Classification Search
CPC ..... B42D 25/387
(Continued)

(56) References Cited

U.S. PATENT DOCUMENTS 5,772,249 A 6/1998 Guex et al.
6,101,939 A 8/2000 Giori et al.
(Continued)

FOREIGN PATENT DOCUMENTS

CA 2 807 458 3/2012
EP 0 710 574 5/1996
(Continued)

OTHER PUBLICATIONS

International Search Report for PCT/IB2014/061406, dated Dec. 4, 2014, 3 pages.
(Continued)

*Primary Examiner* — Kyle Grabowski
(74) *Attorney, Agent, or Firm* — Nixon & Vanderhye P.C.

(57) ABSTRACT

There is described a printed security feature (10) provided onto a printable substrate, which printed security feature includes a printed area (11) with at least a first printed section consisting of a multiplicity of geometric elements (GE, 15) printed with a given distribution over the printed area. The geometric elements are printed with at least first and second inks which exhibit the same or substantially the same optical appearance when illuminated with visible white light, such that the printed security feature produces a first graphical representation (A1) when illuminated with visible white light. At least the first ink is an ink which responds to non-visible light excitation by producing a characteristic optical response differentiating the first ink from the second ink. The printed security feature produces a second graphical representation (B1) when illuminated with non-visible light, which exhibits a distinctive two-
(Continued)

dimensional graphic element (B) which is revealed only when the printed security feature is illuminated with non-visible light. The first printed section is subdivided into at least first and second printed portions (P1, P2), adjacent to the distinctive two-dimensional graphic element, and a third printed portion (P3), inside boundaries (200) of the distinctive two-dimensional graphic element. In the first, respectively second printed portion, the geometric elements are printed with the first, respectively second ink. In the third printed portion, the geometric elements are sub-divided into first and second contiguous portions (GE_a, GE_b) which are respectively printed with the first and second inks. The first and second inks are printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

26 Claims, 24 Drawing Sheets

(51) Int. Cl.

| | |
|---|---|
| ***B41M 3/14*** | (2006.01) |
| ***B42D 25/405*** | (2014.01) |
| ***B42D 25/29*** | (2014.01) |
| ***B42D 25/30*** | (2014.01) |

(52) U.S. Cl.
CPC ..... *B42D 25/405* (2014.10); *B42D 25/00* (2014.10); *B42D 2035/14* (2013.01); *B42D 2035/16* (2013.01); *B42D 2035/24* (2013.01); *B42D 2035/26* (2013.01)

(58) Field of Classification Search
USPC ..... 283/91, 92
See application file for complete search history.

(56) References Cited

U.S. PATENT DOCUMENTS

| | | | | |
|---|---|---|---|---|
| 6,997,482 | B2 | 2/2006 | Mathys | |
| 8,523,238 | B2 | 9/2013 | Sekine et al. | |
| 8,821,996 | B2 | 9/2014 | Bala et al. | |
| 2004/0021311 | A1* | 2/2004 | Shimada | B41M 3/144 283/72 |
| 2004/0036272 | A1 | 2/2004 | Mathys | |
| 2007/0262579 | A1* | 11/2007 | Bala | B41M 3/144 283/92 |
| 2008/0299333 | A1* | 12/2008 | Bala | B42D 25/29 428/29 |
| 2008/0315574 | A1* | 12/2008 | Emerich | B41M 3/14 283/91 |
| 2010/0143578 | A1* | 6/2010 | Reichelsheimer | B41M 3/008 283/72 |
| 2011/0298204 | A1* | 12/2011 | Eschbach | B41M 3/144 283/67 |
| 2012/0251715 | A1* | 10/2012 | Dalal | B42D 25/29 283/85 |
| 2013/0127151 | A1 | 5/2013 | Sekine et al. | |
| 2013/0189455 | A1* | 7/2013 | Sekine | C09D 11/50 428/29 |
| 2013/0221656 | A1* | 8/2013 | Sekine | B41M 3/144 283/92 |

FOREIGN PATENT DOCUMENTS

| | | |
|---|---|---|
| EP | 0 949 069 | 10/1999 |
| EP | 1 291 195 | 3/2003 |
| EP | 1 997 644 | 12/2008 |
| EP | 2 028 017 | 2/2009 |

OTHER PUBLICATIONS

Written Opinion of the ISA for PCT/IB2014/061406, dated Dec. 4, 2014, 4 pages.

* cited by examiner

PRINTED SECURITY FEATURE, OBJECT COMPRISING SUCH A PRINTED SECURITY FEATURE, AND PROCESS OF PRODUCING THE SAME

This application is the U.S. national phase of International Application No. PCT/IB2014/0614606 filed 13 May 2014, which designated the U.S. and claims priority to EP Patent Application Nos. 13167568.8 filed 13 May 2013, and 13179654.2 filed 7 Aug. 2013, the entire contents of each of which are hereby incorporated by reference.

TECHNICAL FIELD

The present invention generally relates to a printed security feature provided onto a printable substrate, which printed security feature includes a printed area consisting of a multiplicity of geometric elements printed with a given distribution over the printed area.

BACKGROUND OF THE INVENTION

European Patent Publications Nos. EP 0 710 574 A2 and EP 1 291 195 A1 each disclose such printed security features.

Further improvements of these known printed security features are required in order to make forgery by counterfeiters even more difficult.

SUMMARY OF THE INVENTION

A general aim of the invention is therefore to improve the known printed security features.

More specifically, an aim of the present invention is to provide such a printed security feature that is both difficult to counterfeit and requires high-precision printing equipment for it to be produced in an adequate manner.

Still another aim of the invention is to provide such a solution which enables the creation of a simple and readily understandable optical effect when illuminated by means of non-visible light, such as ultraviolet light, and which requires simple tools (such as suitable UV light source) in order to control the genuineness of the security feature.

These aims are achieved thanks to a printed security feature defined in the claims.

There is accordingly provided a printed security feature provided onto a printable substrate, which printed security feature includes a printed area with at least a first printed section consisting of a multiplicity of geometric elements printed with a given distribution over the printed area. According to the invention, the geometric elements are printed with at least first and second inks which exhibit the same or substantially the same optical appearance when illuminated with visible white light, such that the printed security feature produces a first graphical representation when illuminated with visible white light, at least the first ink being an ink which responds to non-visible light excitation by producing a characteristic optical response differentiating the first ink from the second ink. The printed security feature produces a second graphical representation when illuminated with non-visible light, which second graphical representation exhibits a distinctive two-dimensional graphic element which is revealed only when the printed security feature is illuminated with non-visible light. The first printed section is subdivided into at least three printed portions including first and second printed portions, adjacent to the distinctive two-dimensional graphic element, and a third printed portion, inside boundaries of the distinctive two-dimensional graphic element. In the first printed portion, the geometric elements are printed with the first ink, while, in the second printed portion, the geometric elements are printed with the second ink. In contrast, in the third printed portion, the geometric elements are subdivided into first and second contiguous portions, the first contiguous portions being printed with the first ink and the second contiguous portions being printed with the second ink. The first and second inks are printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

A key advantage of the present invention resides in the fact that it requires a precise printing process in order to print the at least first and second inks with the adequate register, which printing process is not readily available to counterfeiters. A misregistration between the colours will result in the boundaries of the distinctive two-dimensional graphic element becoming visible under visible light, thereby revealing the presence of the two-dimensional graphic element which is normally concealed under visible light.

In accordance with a particularly advantageous embodiment, the printed area includes, in addition to the first printed section, at least a second printed section likewise consisting of a multiplicity of geometric elements printed with a given distribution over the printed area. The geometric elements of the second printed section are printed with at least third and fourth inks which exhibit the same or substantially the same optical appearance when illuminated with visible white light, which optical appearance of the third and fourth inks is different from the optical appearance of the first and second inks. At least the third ink is an ink which responds to non-visible light excitation by producing a characteristic optical response differentiating the third ink from the fourth ink, which characteristic optical response of the third ink is the same or substantially the same as the characteristic optical response of the first ink. In this case, the first graphical representation and the second graphical representation are formed jointly by the first and second printed sections. The second printed section is likewise subdivided into at least three printed portions including first and second printed portions, adjacent to the distinctive two-dimensional graphic element, and a third printed portion, inside the boundaries of the distinctive two-dimensional graphic element. In the first printed portion of the second printed section, the geometric elements are printed with the third ink. In the second printed portion of the second printed section, the geometric elements are printed with the fourth ink. In the third printed portion of the second printed section, the geometric elements are subdivided into first and second contiguous portions, the first contiguous portions being printed with the third ink and the second contiguous portions being printed with the fourth ink. In this case also, the third and fourth inks are printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

In accordance with one embodiment of the invention, the geometric elements may be linear elements, such as rectilinear and curvilinear elements. In this context, a line width and/or spacing of the linear elements is preferably modulated to produce a halftone image.

In accordance with another embodiment of the invention, the geometric elements may be repetitive elements forming a screen. In this context, the repetitive elements are preferably dimensionally-modulated to produce a halftone image. Such geometric elements could include a juxtaposition of at least first and second distinctive geometric elements, which first and second geometric elements may be separated by an unprinted separation line.

The geometric elements are preferably printed with a spatial frequency of 2 to 50 elements per millimetre. Furthermore, an ink coverage ratio of the printed security feature is advantageously in the range of 30% to 70%, preferably in the range of 40% to 60%, and even more preferably close to 50%.

In accordance with a particularly preferred embodiment (as discussed hereinafter), the first ink is a first fluorescent ink which produces a visible response having a first fluorescent colour when subjected to the non-visible light excitation (preferably ultraviolet excitation), the first fluorescent colour contributing to making the distinctive two-dimensional graphic element visible when the printed security feature is subjected to the non-visible light excitation. According to a particularly advantageous variant of this preferred embodiment, the second ink is a second fluorescent ink which produces a visible response having a second fluorescent colour when subjected to the non-visible light excitation, which second fluorescent colour is distinct from the first fluorescent colour. Inside the boundaries of the distinctive two-dimensional graphic element, the first and second contiguous portions may produce, when subjected to the non-visible light excitation, a third fluorescent colour resulting from additive mixture of the first and second fluorescent colours. This additive mixture of the first and second fluorescent colours is in particular enhanced when the contiguous portions are printed with sufficiently small dimensions so that they cannot be individually resolved by the naked eye.

A ratio of a surface of the first contiguous portions over a surface of the second contiguous portions, inside the boundaries of the distinctive two-dimensional graphic element, can conveniently lie within a range of ½ to 2, which provides flexibility to modulate the intensity of the colour appearance of the distinctive two-dimensional graphic element when it is revealed as a result of illumination of the printed security feature with non-visible light. This is especially useful in order to modulate the respective contributions of first and second fluorescent inks discussed above.

In accordance with a further variant of the invention, the first and second contiguous portions, inside the boundaries of the distinctive two-dimensional graphic element, may produce, when subjected to the non-visible light excitation, a structure comprising geometric patterns having a distinctive shape that is different from a shape of the geometric elements.

The multiplicity of geometric elements is preferably printed by Simultan-offset, namely by inking first and second offset printing plates with the first and second inks, respectively, and by transferring resulting first and second ink patterns from the first and second offset printing plates onto a common blanket cylinder prior to printing. Other printing processes could be contemplated (such as intaglio printing) provided the printing process is adapted to print the multiplicity of geometric elements with an adequate register between the first and second inks.

Also claimed is an object comprising a substrate and a printed security feature in accordance with the invention, which printed security feature is provided onto the substrate. In this context, the printed security feature is advantageously provided on a portion of the substrate which absorbs a substantial part of the non-visible light excitation. This portion can either be a portion of the substrate itself or a suitable layer applied onto the substrate prior to printing of the security feature. This portion ensures a better contrast between the security feature and the background (when illuminated with non-visible light) as the background will appear mostly dark under illumination with non-visible light.

The object can be a value document (in particular a high security document such as a banknote), or a security element that is applicable onto an article to be protected against forgery (in particular a foil element, such as transferable foil element that can be transferred by e.g. hot-stamping or a foil element that can be laminated onto a suitable surface of the article).

Also claimed is a process of producing an object comprising a substrate and a printed security feature, wherein the process includes providing a printable substrate and printing the security feature in accordance with the invention onto the substrate.

Further advantageous embodiments of the invention are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 1A:
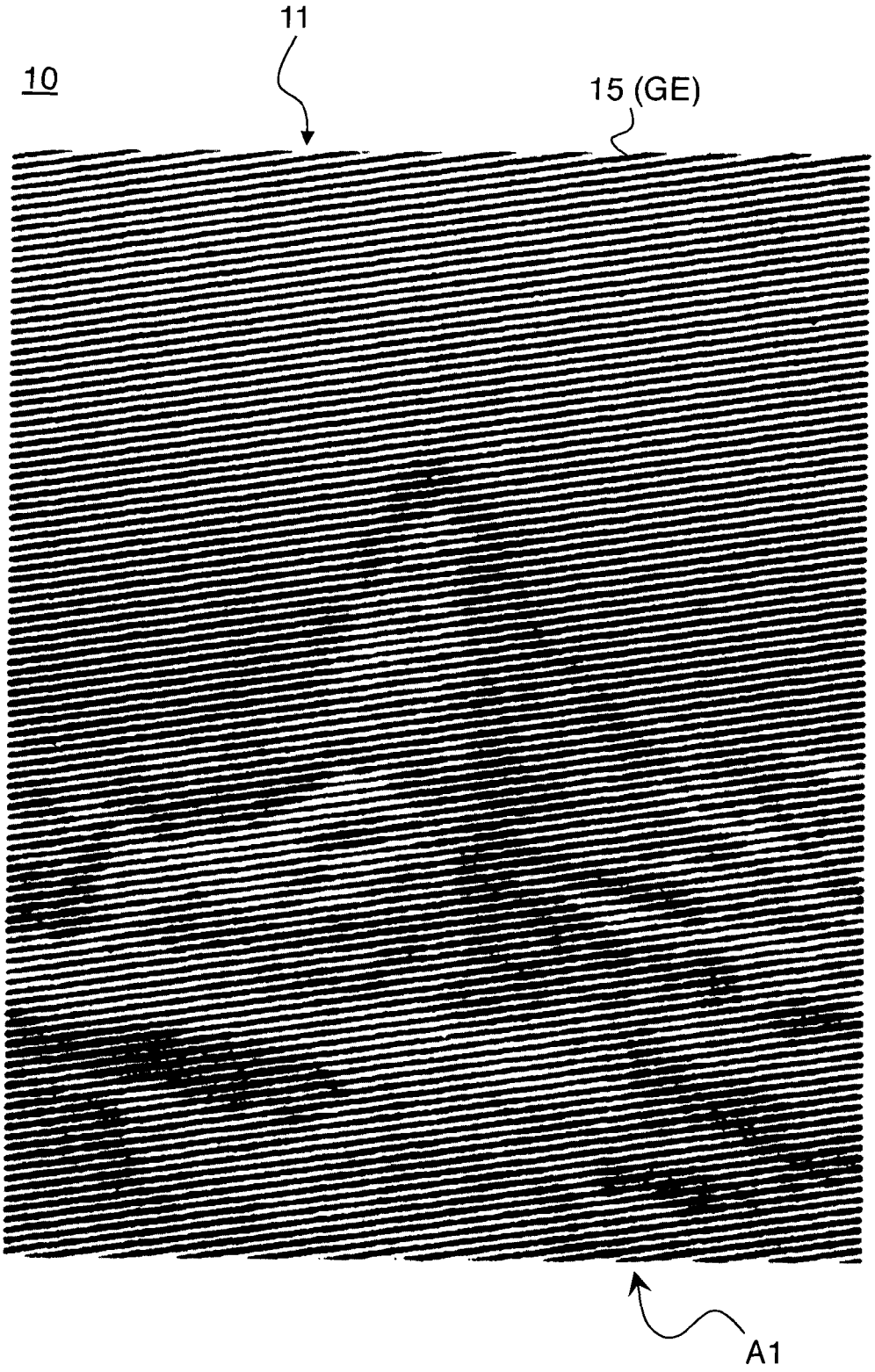
FIG. 1A is a schematic view of a printed security feature in accordance with a first embodiment of the invention, FIG. 1A illustrating the printed security feature when illuminated with visible white light.

The present invention will be described in the particular context of a printed security feature which is printed by means of at least first and second fluorescent inks which produce corresponding visible responses when subjected to non-visible light excitation, the first and second inks producing distinct visible responses having respectively first and second fluorescent colours which are different from one another. In the examples that will be described hereinafter, the first fluorescent ink is an ink that fluoresces a green colour, while the second fluorescent ink is an ink that fluoresces a red colour. These examples are purely illustrative and other fluorescent colours could be contemplated without departing from the scope of the invention as defined by the claims.

As this will be appreciated hereinafter, the first and second fluorescent inks may advantageously combine, in certain locations of the printed security feature, to form a third fluorescent colour resulting from additive mixture of the first and second fluorescent colour. It will however be appreciated that the third colour will actually be dependent on the relevant dimensions of the areas printed with the first and second inks and the relevant contributions of the first and second fluorescent colours in the additive mixture. Small dimensions that cannot be resolved by the naked eye will enhance the additive mixture of the first and second fluorescent colours as the individual portions printed with the two inks will not be visible to the naked eye in the regions where they are contiguous. The more the red contribution, the more the third colour will turn from yellow to orange and to red. The more the green contribution, the more the third colour will turn to a light green and to green.

This being said, it is also possible, within the scope of the invention, to conceive the relevant locations of the printed security feature where the two inks are contiguous in such a way as to create a fluorescent structure that is recognizable with the naked eye.

In any event, the resulting structure produced by the combination of the first and second inks provides additional security in that it can be identified either by the naked eye or by means of suitable magnifying means.

It the present example, it will be assumed that the non-visible light excitation is ultraviolet excitation. It is however to be appreciated that the non-visible light excitation could alternatively be a near-infrared excitation or any other excitation outside the visible spectrum that can suitably trigger a visible response. Within the scope of the present invention, only one or more than two inks responsive to the non-visible light excitation could be contemplated.

FIGS. 1A-E to 11A-B show examples of a printed security feature in accordance with various embodiments of the invention. It is to be appreciated that the printed security features depicted in FIGS. 1A-E to 11A-B are not drawn to scale, but illustrated as enlarged views. In practice, the overall dimensions of the security feature is in the range of a few centimetres in height and width.

In each case, the printed security feature is provided on a suitable printable substrate and includes a printed area consisting of a multiplicity of geometric elements (generically designated by reference GE) that are printed with a given distribution over the printed area. In this context, the printed security feature is advantageously provided on a portion of the substrate which absorbs a substantial part of the non-visible light excitation. This portion can either be a portion of the substrate itself or a suitable layer applied onto the substrate prior to printing of the security feature. This portion ensures a better contrast between the security feature and the background (when illuminated with non-visible light) as the background will appear mostly dark under illumination with non-visible light (as shown in the photographic illustrations of FIGS. 1B, 2B, 3B, 4B, 5B, 6B, 7B, 8B, 9B, 10B and 11B).

In the examples that will be discussed hereinafter, the geometric elements are advantageously printed with at least first and second fluorescent inks (namely a green fluorescent ink and a red fluorescent ink as mentioned above) which exhibit the same or substantially the same optical appearance when illuminated with visible white light, such that the printed security feature produces a first graphical representation (designated by references A1 to A11 in FIGS. 1A, 2A, 3A, 4A, 5A, 6A, 7A, 8A, 9A, 10A, 11A) when illuminated with visible white light. The printed security feature produces a second graphical representation (designated by references B1 to B11 in FIGS. 1B, 2B, 3B, 4B, 5B, 6B, 7B, 8B, 9B, 10B, 11B) when illuminated with non-visible light, which second graphical representation exhibits a distinctive two-dimensional graphic element (designated by reference B) which is revealed only when the printed security feature is illuminated with non-visible light. In the examples, the distinctive two-dimensional graphic element forms the pattern "100", it being to be appreciated that the two-dimensional graphic element could take any desired shape or form.

In the context of an alternate (twelfth) embodiment, it will be appreciated that third and fourth fluorescent inks are used in addition to the first and second fluorescent inks, the third and fourth fluorescent inks exhibiting the same or substantially the same optical appearance when illuminated with visible white light, which optical appearance is however different from the optical appearance of the first and second fluorescent inks. When illuminated with non-visible light, the printed security feature in accordance with this alternate embodiment produces the same (or substantially the same) second graphical representation with the distinctive two-dimensional graphic element B which is revealed only when the printed security feature is illuminated with non-visible light (i.e. the pattern "100").

Figure 1B:
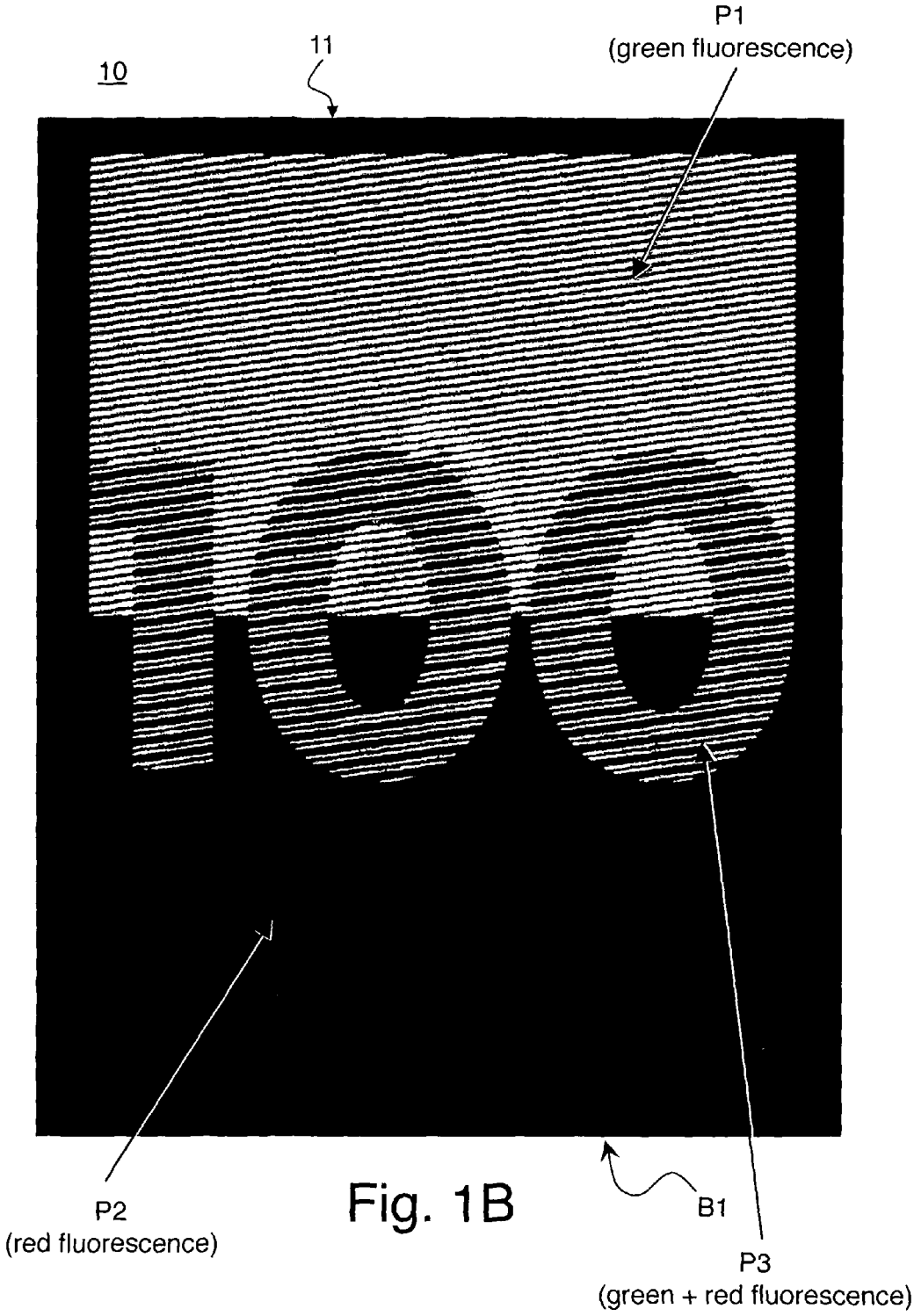
FIG. 1B is a photographic illustration of the printed security feature of FIG. 1A when illuminated with non-visible light, namely ultraviolet light in this example, which reveals the distinctive two-dimensional graphic element that is not visible under visible white light.
Figure 1C:
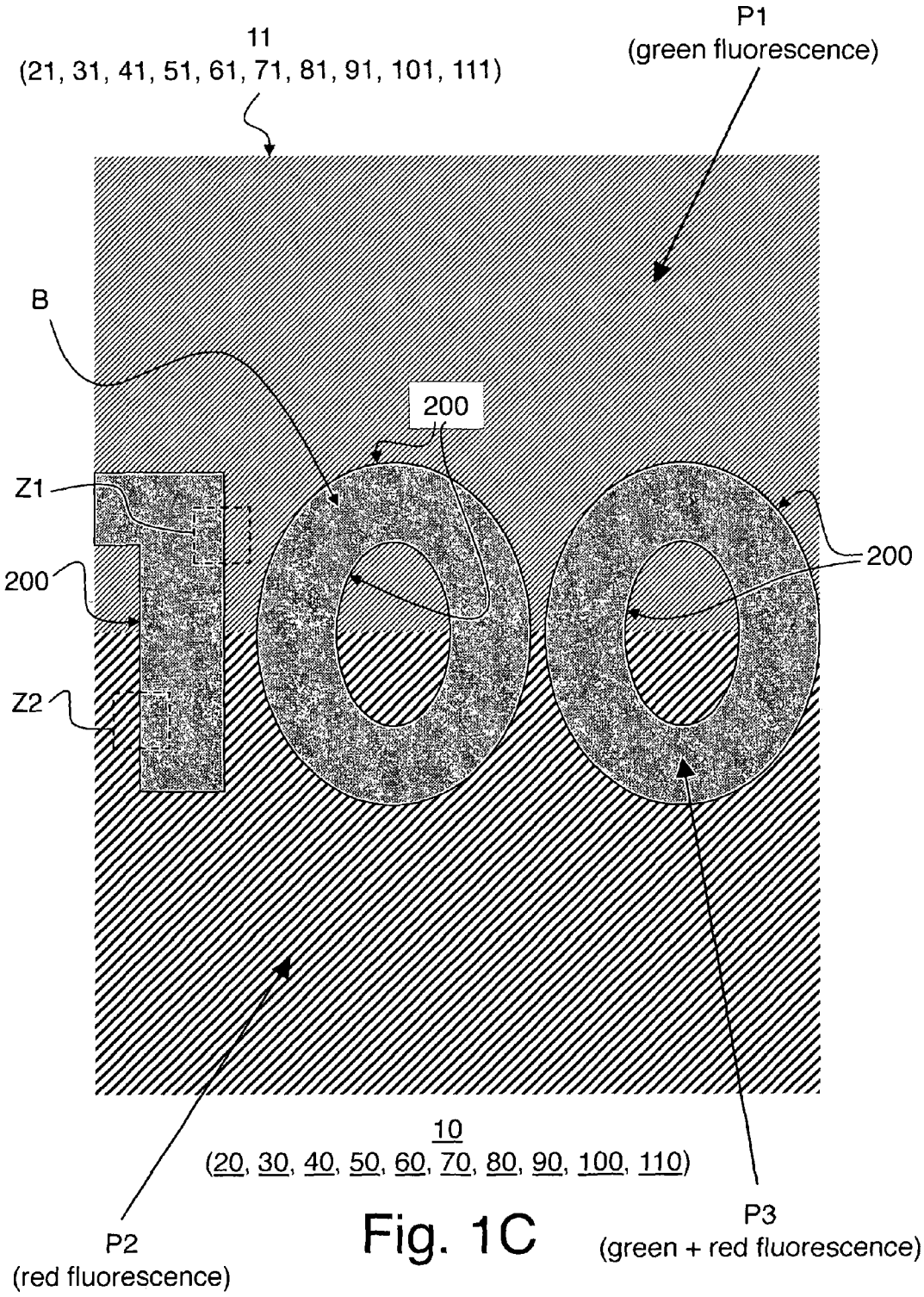
FIG. 1C is a schematic illustration of the subdivision of the printed area of the printed security feature of FIG. 1A into corresponding printed portions leading to the graphical representation and distinctive two-dimensional graphic element of FIG. 1B.

In all of the examples of FIGS. 1A-E to 11A-B, the printed area of the printed security features includes one printed section that is subdivided into at least three printed portions including first and second printed portions (designated by reference P1, P2), adjacent to the distinctive two-dimensional graphic element B, and a third printed portion P3, inside boundaries 200 of the distinctive two-dimensional graphic element B, which subdivision is schematically illustrated by FIG. 1C. In the first printed portion P1, the geometric elements GE are printed with the first ink, namely the green fluorescent ink in the illustrative examples. In the second printed portion P2, the geometric elements GE are printed with the second ink, namely the red fluorescent ink in the illustrative examples. In contrast, in the third printed portion P3 (i.e. inside the boundaries 200 of the distinctive two-dimensional element B), the geometric elements GE are subdivided into first and second contiguous portions (designated generically by references GE_a, GE_b), the first contiguous portions GE_a being printed with the first (green fluorescent) ink and the second contiguous portions GE_b being printed with the second (red fluorescent) ink.

In a particular illustrative example of the twelfth embodiment mentioned above, the printed area of the printed security feature includes two printed sections that are each printed along the same principle. More precisely, the lower section of the printed security feature is printed with the same first and second fluorescent inks as in the other embodiments. The upper section of the printed security feature is printed with the aforementioned third and fourth fluorescent inks, which exhibit a different optical appearance under visible light than the first and second fluorescent inks, but the same fluorescent properties as the first and second fluorescent inks. The upper portion is likewise subdivided in at least three printed portions, including first and second printed portions, adjacent to the distinctive two-dimensional graphic element B, and a third printed portion, inside boundaries 200 of the distinctive two-dimensional graphic element B, as again schematically illustrated by FIG. 1G. In this case, in the first printed portion of the upper section, the geometric elements GE are printed with the third ink, namely a green fluorescent ink in the illustrative example. In the second printed portion of the upper section, the geometric elements GE are printed with the fourth ink, namely a red fluorescent ink in the illustrative example. Likewise, in the third printed portion of the upper section (i.e. inside the boundaries 200 of the distinctive two-dimensional element B), the geometric elements GE are subdivided into first and second contiguous portions (designated generically by references GE_a, GE_b), the first contiguous portions GE_a being printed with the third (green fluorescent) ink and the second contiguous portions GE_b being printed with the fourth (red fluorescent) ink. As the first and third fluorescent inks, respectively the second and fourth fluorescent inks, exhibit the same fluorescent colours, the resulting (second) graphical representation that is revealed under non-visible light remains substantially the same as in the other embodiments (see FIG. 8B).

It will be appreciated that the illustrated examples all share a common subdivision into the printed portions P1, P2, P3 as illustrated in FIG. 1C. The invention is not limited however to this particular subdivision which is purely illustrative.

It shall be understood that, in accordance with the invention, the first and second inks are printed in register one with respect to the other so that the boundaries 200 of the distinctive two-dimensional graphic element B are not visible when the printed security feature is illuminated with visible white light and the distinctive two-dimensional graphic element B only becomes visible when the printed security feature is illuminated with non-visible light.

FIG. 1A is a schematic view of a printed security feature, designated by reference numeral 10, in accordance with a first embodiment of the invention, FIG. 1A illustrating the printed security feature 10 when illuminated with visible white light. According to this first embodiment, the printed security feature 10 include a printed area 11 consisting of a multiplicity of geometric elements GE, designated by reference numeral 15, which takes the shape of multiple parallel linear elements printed with a given spatial frequency (which can advantageously be of the order of 2 to 50 lines per millimetre). In this example, the line width of the linear elements is advantageously modulated to produce a halftone image A1, namely a representation of the famous Matterhorn (or Mont Cervin) mountain.

FIG. 1B is a photographic illustration of the printed security feature 10 when illuminated with non-visible light, namely ultraviolet light in this example, which reveals the second graphical representation B1 and the distinctive two-dimensional graphic element B that is not visible under visible white light. More precisely, the first printed portion P1, adjacent to and above the pattern "100", appears as a fluorescent green region, whereas the second printed portion P2, adjacent to and below the pattern "100", appears as a red fluorescent region (see also schematic illustration of FIG. 1C). Inside the boundaries 200 of the two-dimensional graphic element B, the third printed portion P3 appears as a region where both the green fluorescent (first) ink and the red fluorescent (second) ink contribute to the overall appearance of the distinctive two-dimensional element B.

Figure 1D:
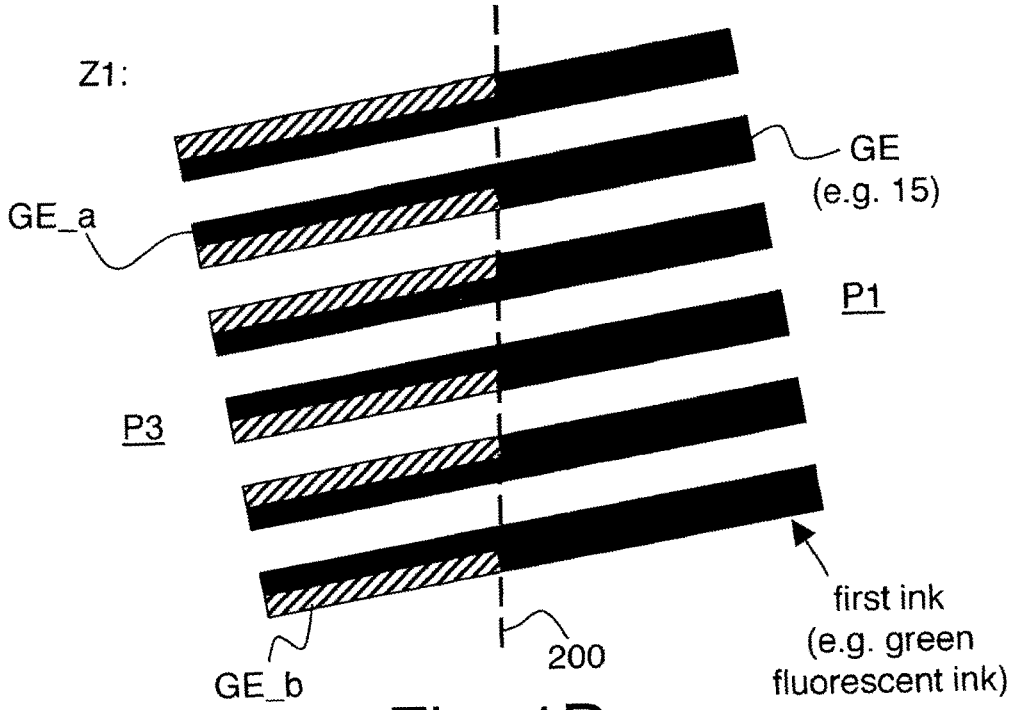
FIGS. 1D and 1E are detailed views of first and second partial areas of the printed security feature of FIG. 1A showing details of the geometric elements constituting the printed area of the security feature, inside and outside of boundaries of the distinctive two-dimensional graphic element.
Figure 1E:
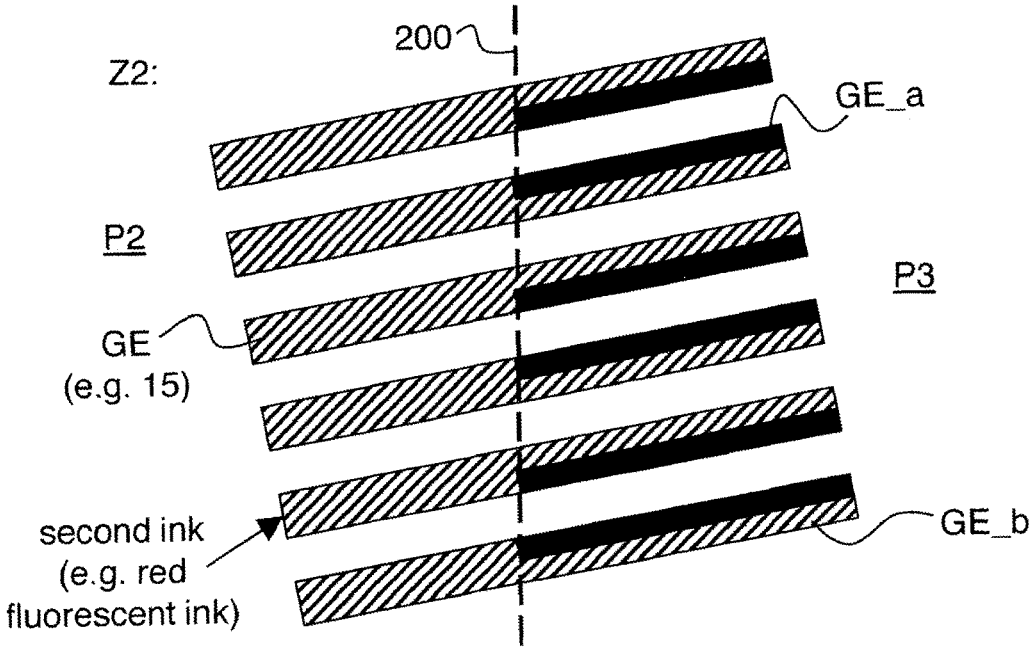

FIGS. 1D and 1E are detailed views of first and second partial areas Z1, Z2 (as located in FIG. 1C) of the printed security feature of FIG. 1A showing details of the geometric elements GE (15) constituting the printed area 11 of the security feature 10, inside and outside of the boundaries 200 of the distinctive two-dimensional graphic element B. FIGS. 1D and 1E illustrate that, inside the boundaries 200 of the two-dimensional graphic element B, i.e. in the third printed portion P3, the geometric elements GE (15) are subdivided into first and second contiguous portions GE_a, GE_b. In other words, the first and second contiguous portions GE_a, GE_b are printed so as to join one with the other and be contiguous. The first contiguous portions GE_a are printed with the first fluorescent ink (i.e. the fluorescent green ink identified by a solid colour in FIGS. 1D and 1E), while the second contiguous portions GE_b are printed with the second ink (i.e. the fluorescent red ink—identified by hatchings in FIGS. 1D and 1E). Outside the boundaries 200 of the two-dimensional graphic element B, i.e. in the first and second printed portions P1, P2, the geometric elements GE (15) are printed with only the first ink (see e.g. FIG. 1D) or the second ink (see e.g. FIG. 1E).

The first and second inks are printed in register one with respect to the other so that the boundaries 200 of the two-dimensional graphic element B are not visible when the printed security feature is illuminated with visible white light and the two-dimensional graphic element B only becomes visible when the printed security feature is illuminated with non-visible light.

Figure 2A:
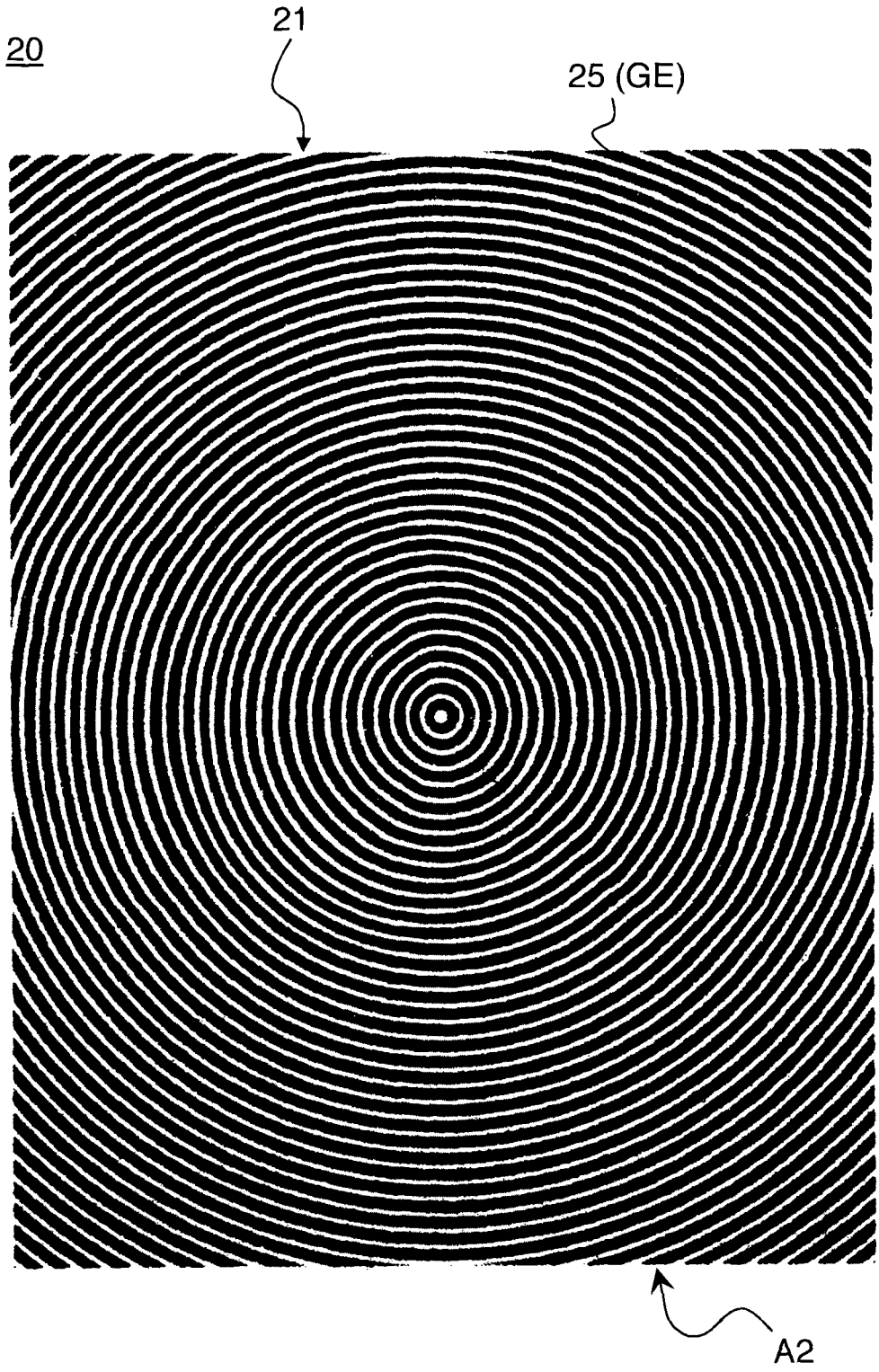
FIG. 2A is a schematic view of a printed security feature in accordance with a second embodiment of the invention, FIG. 2A illustrating the printed security feature when illuminated with visible white light.

FIG. 2A is a schematic view of a printed security feature, designated by reference numeral 20, in accordance with a second embodiment of the invention, FIG. 2A illustrating the printed security feature 20 when illuminated with visible white light. According to this second embodiment, the printed security feature 20 include a printed area 21 consisting of a multiplicity of geometric elements GE, designated by reference numeral 25, which takes the shape of curvilinear elements in the form of concentric circles. The spatial frequency of the concentric circles can likewise be of the order of 2 to 50 lines per millimetre. In contrast to the first embodiment, no visible modulation of the line width (and/or spacing) of the geometric element was carried out, the printed security feature 20 exhibiting a substantially uniform appearance A2. Advantageously, a slight modulation is carried out (which modulation is not readily visible to the naked eye) in accordance with the principle discussed in European Patent Publication No. EP 1 291 195 A1, which is incorporated herein by reference in its entirety. As taught by EP 1 291 195 A1, a corresponding pattern could be printed on a reverse side of the substrate where the printed security feature 20 is provided so as to generate a so-called see-through feature providing additional security.

Figure 2B:
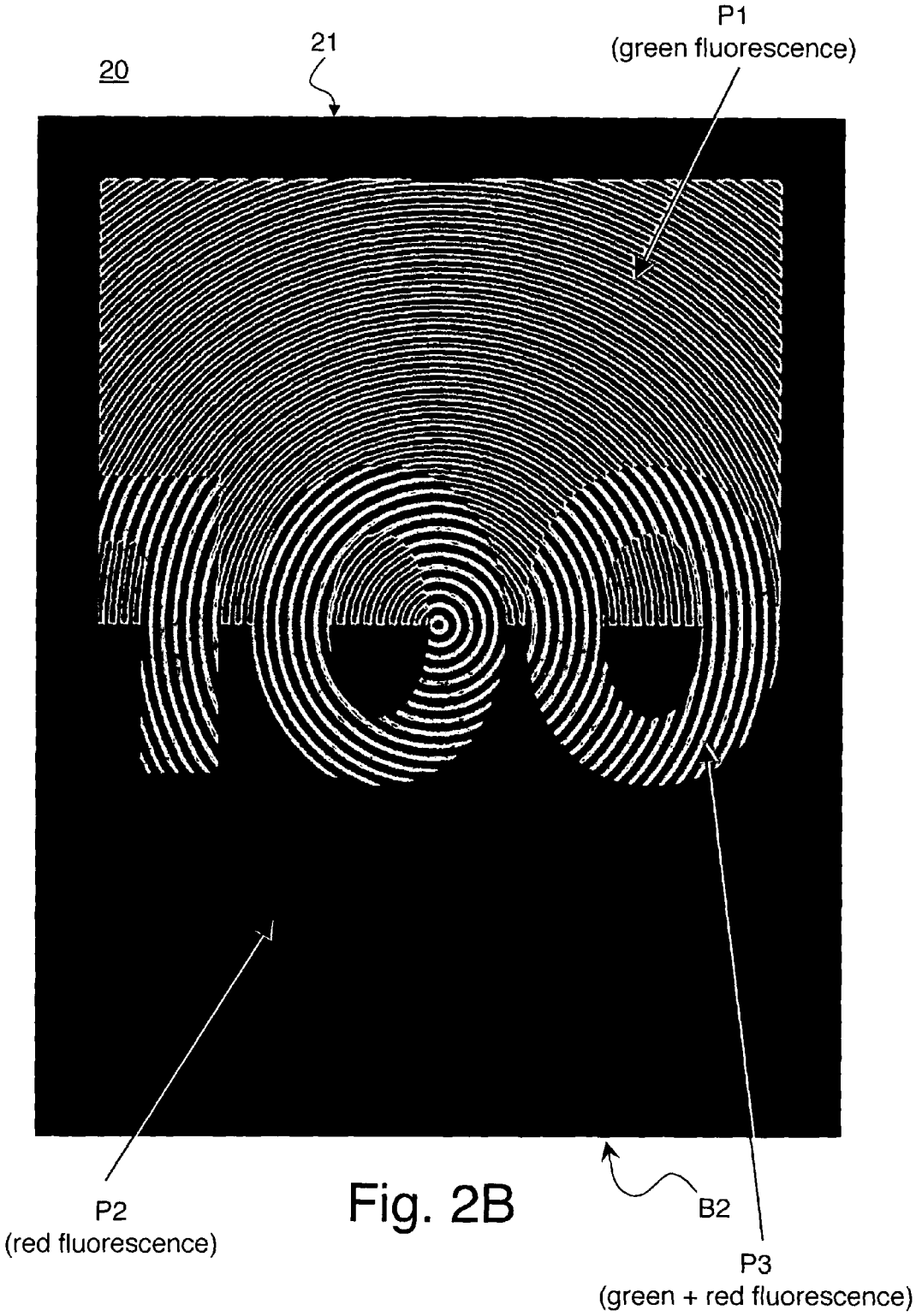
FIG. 2B is a photographic illustration of the printed security feature of FIG. 2A when illuminated with non-visible light, namely ultraviolet light in this example, which reveals the distinctive two-dimensional graphic element that is not visible under visible white light.

FIG. 2B is a photographic illustration of the printed security feature 20 when illuminated with non-visible light, namely ultraviolet light in this example, which reveals the second graphical representation B2 and the distinctive two-dimensional graphic element B that is not visible under visible white light. Except for the particular arrangement and distribution of the geometric elements on the printed area 21 (which differ from that of the first embodiment), the resulting graphical representation B2 under ultraviolet light is similar to that of FIG. 1B. In particular, the subdivision of the printed area 21 into the three printed portions P1, P2, P3 is identical to that illustrated in FIG. 1C (the same applies to the examples illustrated in FIGS. 3A-B to 11A-B).

Figure 3A:
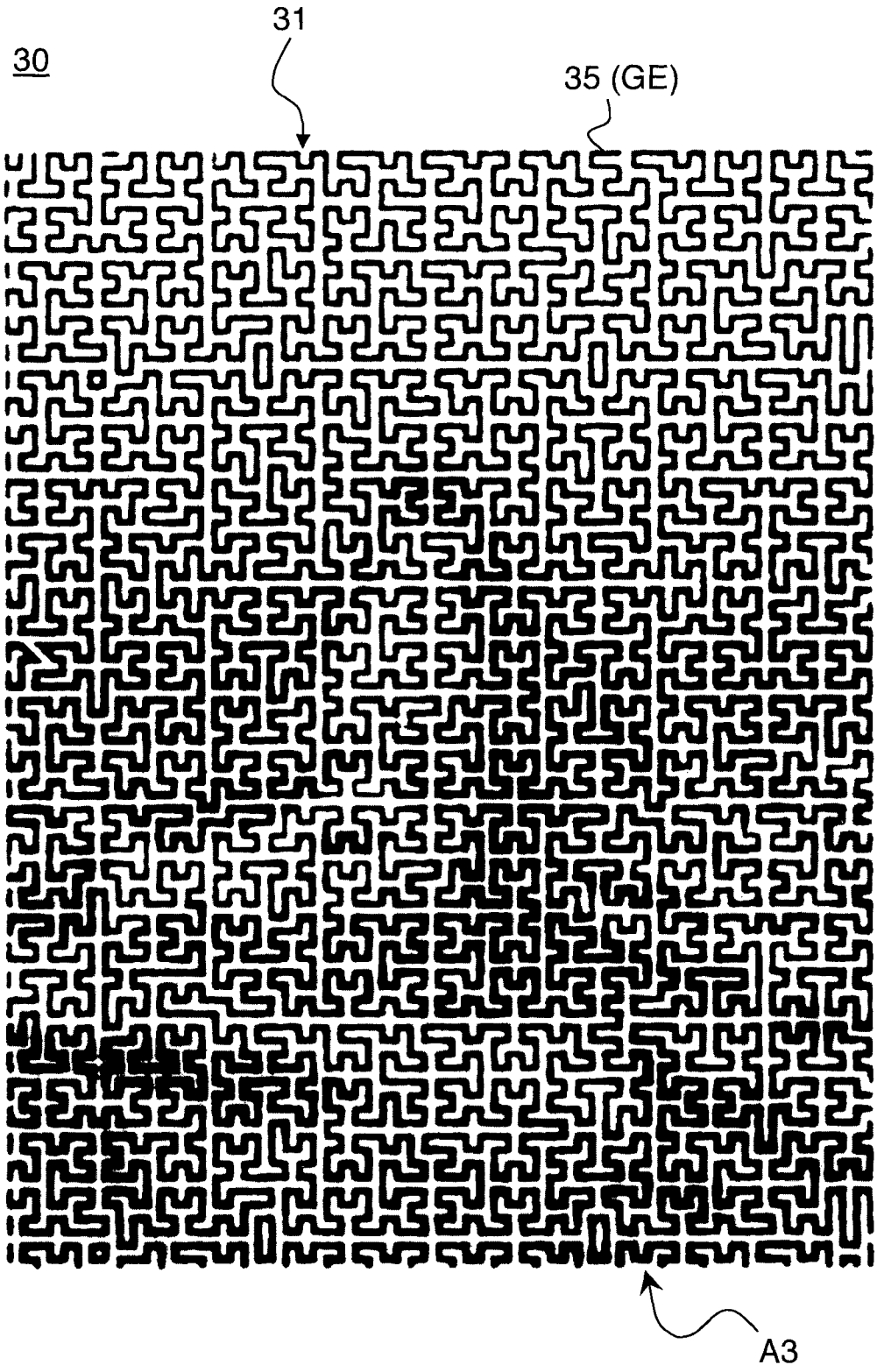
FIG. 3A is a schematic view of a printed security feature in accordance with a third embodiment of the invention, FIG. 3A illustrating the printed security feature when illuminated with visible white light.

FIG. 3A is a schematic view of a printed security feature, designated by reference numeral 30, in accordance with a third embodiment of the invention, FIG. 3A illustrating the printed security feature 30 when illuminated with visible white light. According to this third embodiment, the printed security feature 30 include a printed area 31 consisting of a multiplicity of geometric elements GE, designated by reference numeral 35, which takes the shape of an intricate arrangement of linear elements extending at right angles over the surface of the printed area 31. Like the first embodiment, the line width of the linear elements GE (35) is advantageously modulated to produce a halftone image A3, namely a representation of the Matterhorn mountain.

Figure 3B:
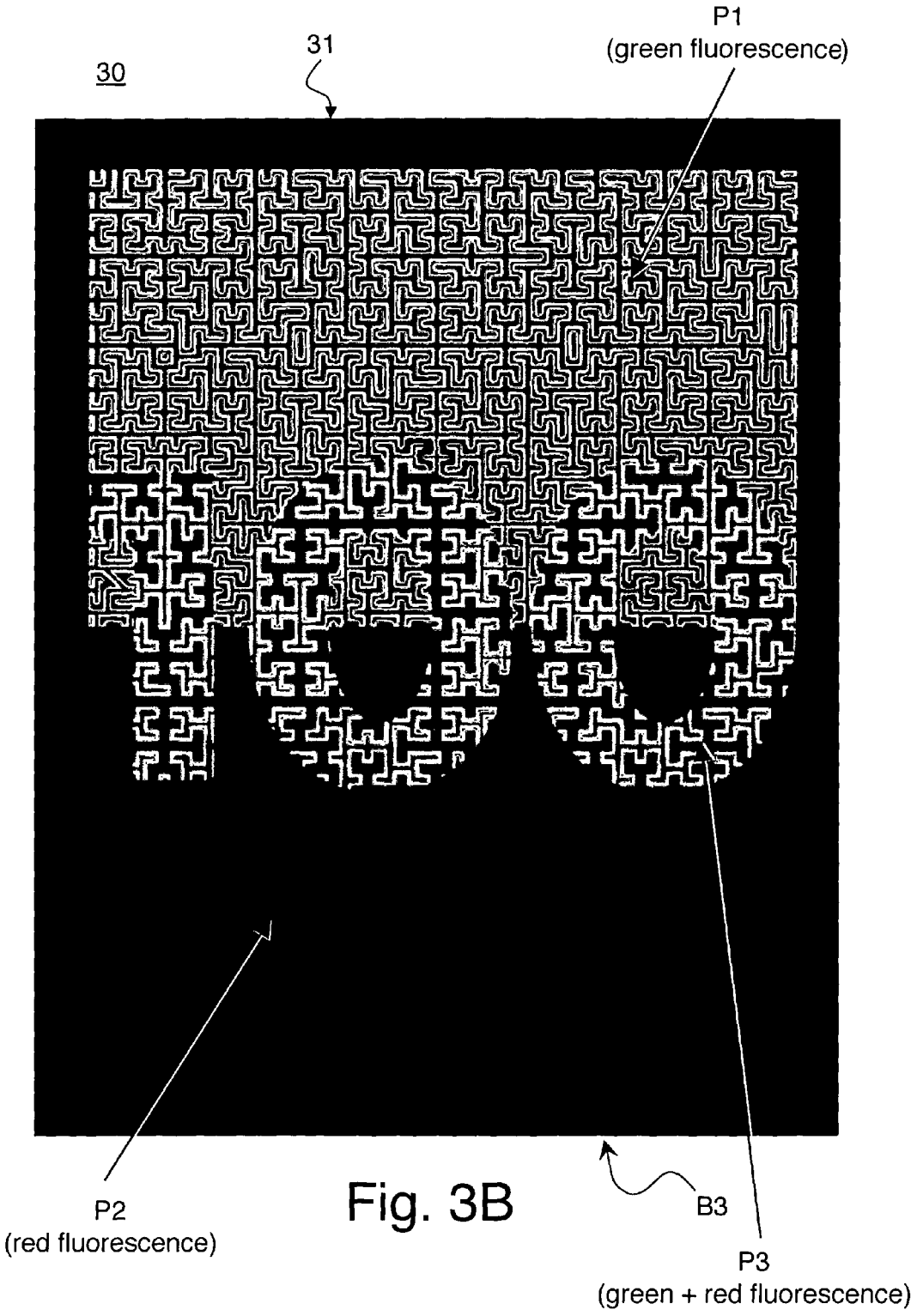
FIG. 3B is a photographic illustration of the printed security feature of FIG. 3A when illuminated with non-visible light, namely ultraviolet light in this example, which reveals the distinctive two-dimensional graphic element that is not visible under visible white light.

FIG. 3B is a photographic illustration of the printed security feature 30 when illuminated with ultraviolet light, which reveals the second graphical representation B3 and the distinctive two-dimensional graphic element B that is not visible under visible white light. Except for the particular arrangement and distribution of the geometric elements on the printed area 31 (which differ from that of the first and second embodiments), the resulting graphical representation B3 under ultraviolet light is similar to that of FIGS. 1B and 2B. This being said, the intricate arrangement of the linear elements GE (35) and the particular combination of the first and second inks lead to a particular fluorescent structure in the printed region P3 that is identifiable and provides additional security.

FIGS. 4A, 5A, 6A, 7A and 8A are schematic views of printed security features, designated respectively by reference numerals 40, 50, 60, 70 and 80, in accordance with fourth to eight embodiments of the invention, illustrating once again the printed security features when illuminated with visible white light. According to these embodiments, the printed security feature 40, 50, 60, 70, 80 includes a printed area 41, 51, 61, 71, 81, respectively, consisting of a multiplicity of geometric elements GE, designated by reference numerals 45, 55, 65-66, 75 and 85-86, respectively, which takes the shape of repetitive elements forming a screen, which repetitive elements are dimensionally-modulated to produce a corresponding halftone image A4, A5, A6, A7, A8, respectively, representing the Matterhorn mountain (like the first and third embodiments). The repetitive elements may advantageously be printed with a spatial frequency of 2 to 50 elements per millimetre.

In the fourth embodiment, the repetitive elements are interconnected contiguous geometric elements 45 (here designed as cubic shapes), whereas in the fifth to eighth embodiments, the repetitive elements 55, 65-66, 71, 85-86 are not contiguous in certain locations of the relevant printed area 51, 61, 71, 81. In the sixth embodiment, the geometric elements GE include a juxtaposition of first and second distinctive geometric elements 65-66, namely first geometric elements 65 having the shape of a cross and second geometric elements 66 having the shape of a square. In the seventh embodiment, the geometric elements GE include the alphanumerical string "100" which is repeated over the surface of the printed area 71. In the eighth embodiment, the geometric elements GE include a juxtaposition of first and second geometric elements 85, 86 which are separated by an unprinted separation line 88.

FIGS. 4B, 5B, 6B, 7B and 8B are photographic illustrations of the printed security feature 40, 50, 60, 70, 80, respectively, when illuminated with ultraviolet light, which once again reveals the second graphical representation B4, B5, B6, B7, B8, respectively, and the distinctive two-dimensional graphic element B that is not visible under visible white light. Except for the particular arrangement and distribution of the geometric elements on the printed areas 41, 51, 61, 71, 81 (which differ from that of the previous embodiments), the resulting graphical representation B4, B5, B6, B7, B8 under ultraviolet light is similar to that of FIGS. 1B, 2B and 3B. In particular, the subdivision of the printed areas 41, 51, 61, 71, 81 into the three printed portions P1, P2, P3 is identical to that illustrated in FIG. 1C.

The subdivision of the geometric elements GE (45) of the fourth embodiment into the contiguous portions GE_a, GE_b is similar in principle to the subdivision adopted in the context of the first to third embodiments, namely follows substantially the relevant shape of the geometric elements GE (45). In contrast, in the context of the fifth to eight embodiments, the first and second contiguous portions GE_a, GE_b produce, when subjected to the non-visible light excitation, a structure comprising geometric patterns having a distinctive shape that is different from a shape of the geometric element GE (55, 65-66, 75, 85-86). More precisely, the structure shown in the fifth and eighth embodiments (FIGS. 5B and 8B) exhibits repetitive triangular patterns which can be readily distinguished from the geometric elements GE (55, 85-86). Likewise, in the sixth embodiment (FIG. 6B), the structure appears like a chessboard pattern with individual square elements that can be distinguished from the geometric elements GE (65-66). In the case of the seventh embodiment (FIG. 7B), the structure exhibits an alternation of horizontal lines that can be distinguished from the alphanumerical string "100". This principle is applicable irrespective of the actual shape of the geometric elements GE and could for instance be applied in the context of the first to third (and ninth to eleventh) embodiments.

Figure 9A:
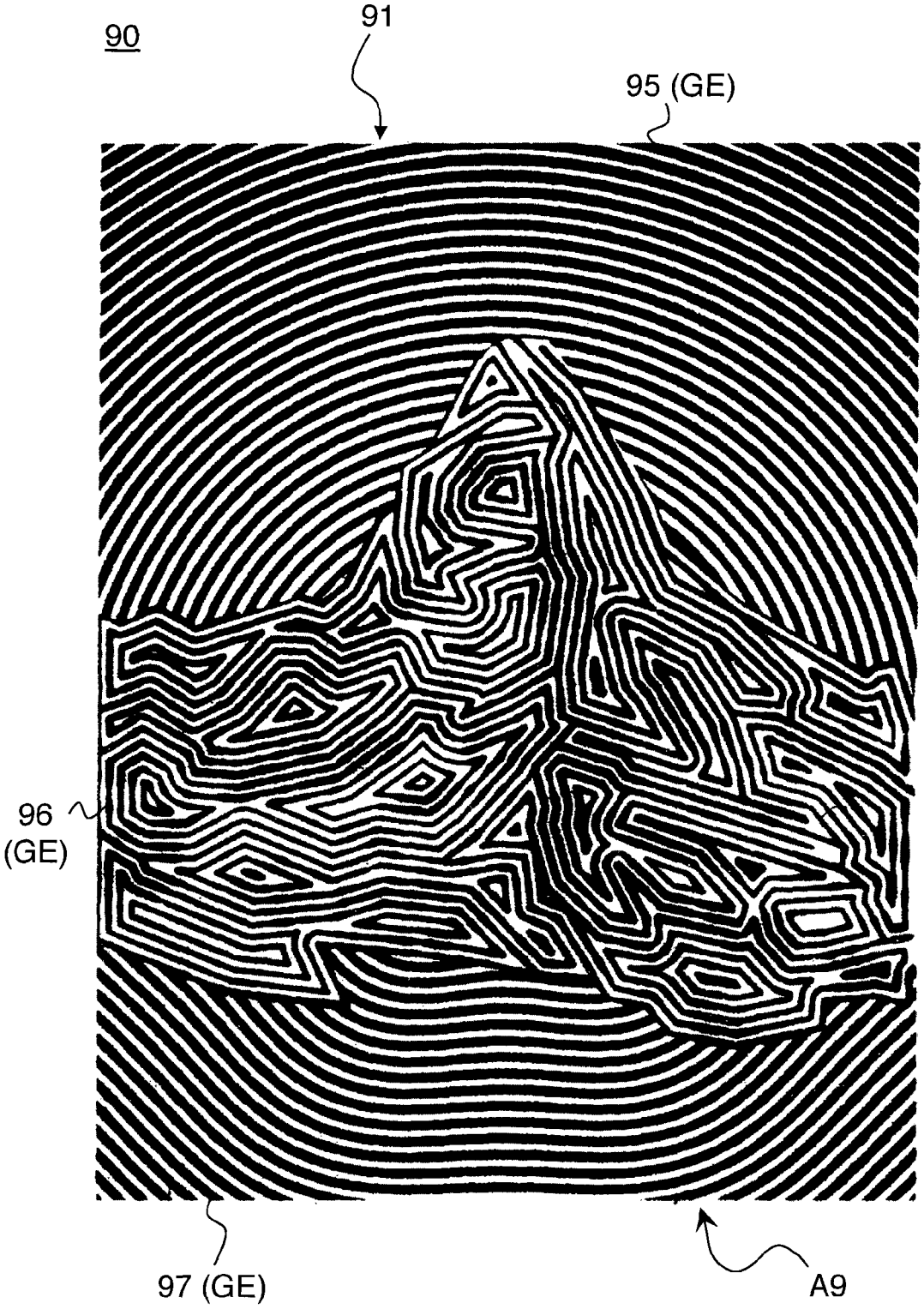
FIG. 9A is a schematic view of a printed security feature in accordance with a ninth embodiment of the invention, FIG. 9A illustrating the printed security feature when illuminated with visible white light.
Figure 10A:
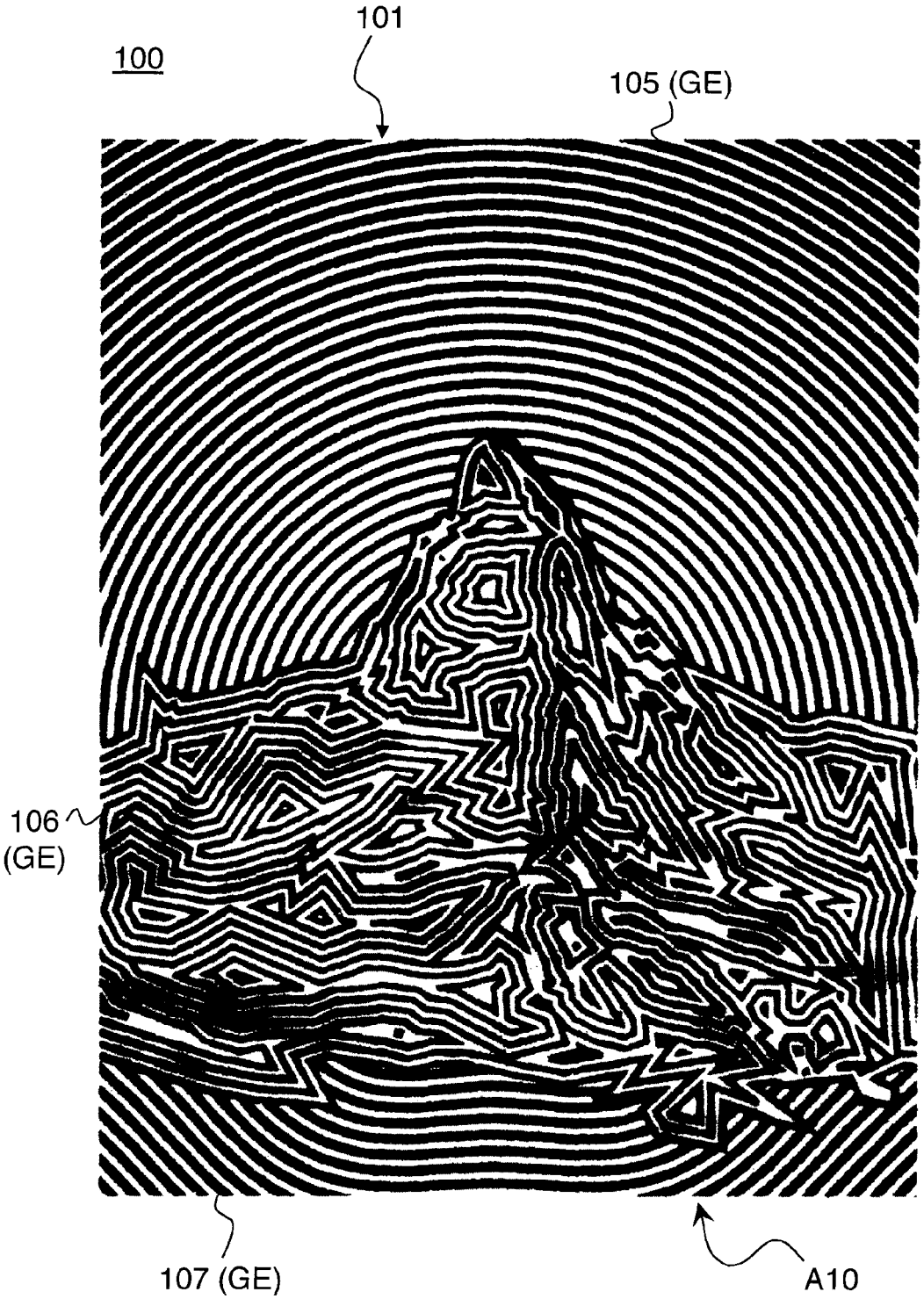
FIG. 10A is a schematic view of a printed security feature in accordance with a tenth embodiment of the invention, FIG. 10A illustrating the printed security feature when illuminated with visible white light.
Figure 11A:
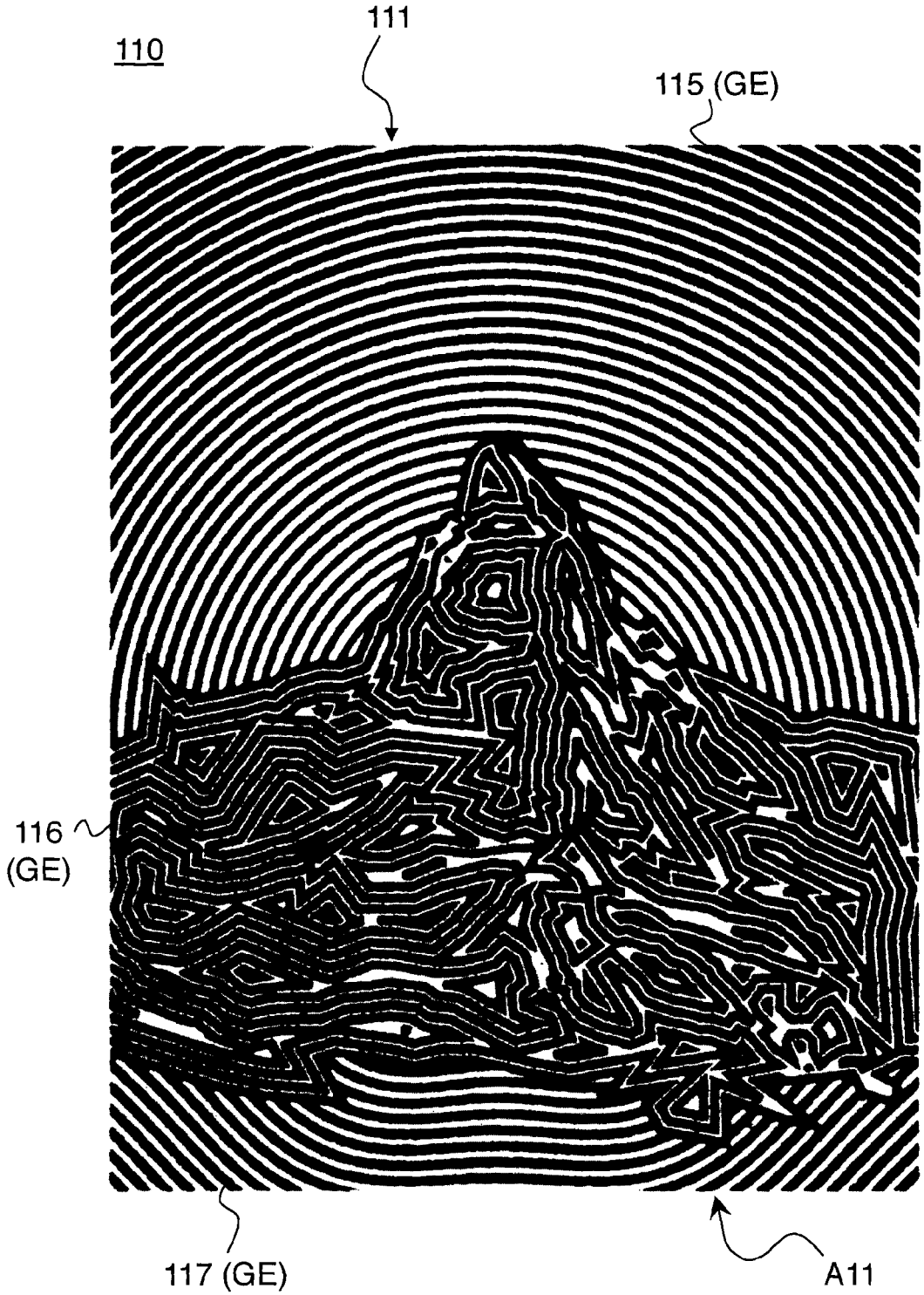
FIG. 11A is a schematic view of a printed security feature in accordance with an eleventh embodiment of the invention, FIG. 11A illustrating the printed security feature when illuminated with visible white light.

FIGS. 9A, 10A and 11A are schematic views of printed security features, designated respectively by reference numerals 90, 100 and 110, in accordance with ninth to eleventh embodiments of the invention, illustrating once again the printed security features when illuminated with visible white light. According to these embodiments, the printed security feature 90, 100, 110 includes a printed area 91, 101, 111, respectively, consisting of a multiplicity of geometric elements GE, designated by reference numerals 95-97, 105-107 and 115-117, respectively, which takes the shape of an intricate arrangement of linear elements, namely rectilinear and curvilinear elements, extending over the surface of the printed area 91, 101, respectively 111. The linear elements are dimensionally-modulated to produce a corresponding halftone image A9, A10, respectively A11 again representing the Matterhorn mountain (like the first and third to eighth embodiments).

Figure 9B:
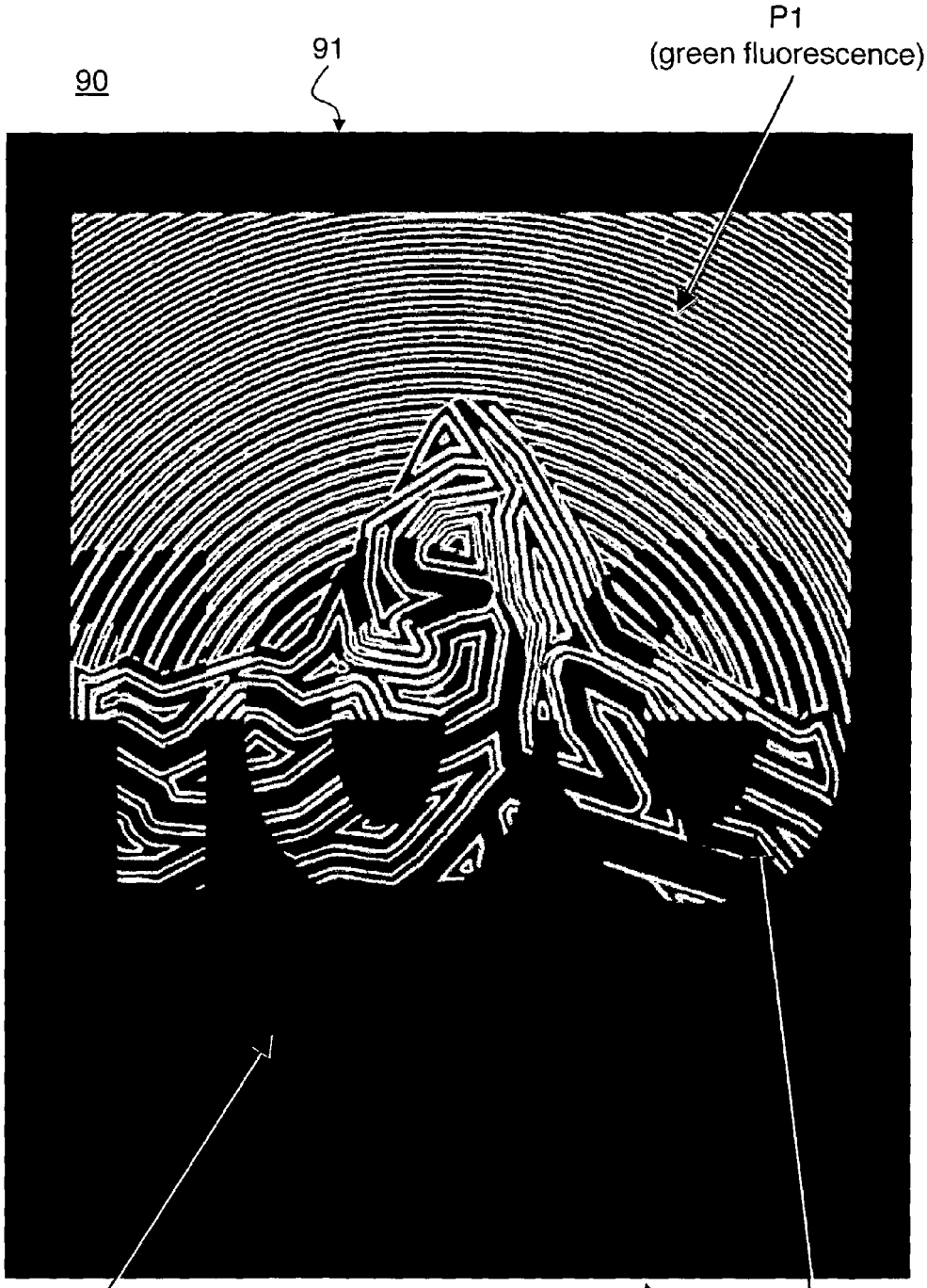
FIG. 9B is a photographic illustration of the printed security feature of FIG. 9A when illuminated with non-visible light, namely ultraviolet light in this example, which reveals the distinctive two-dimensional graphic element that is not visible under visible white light.
Figure 10B:
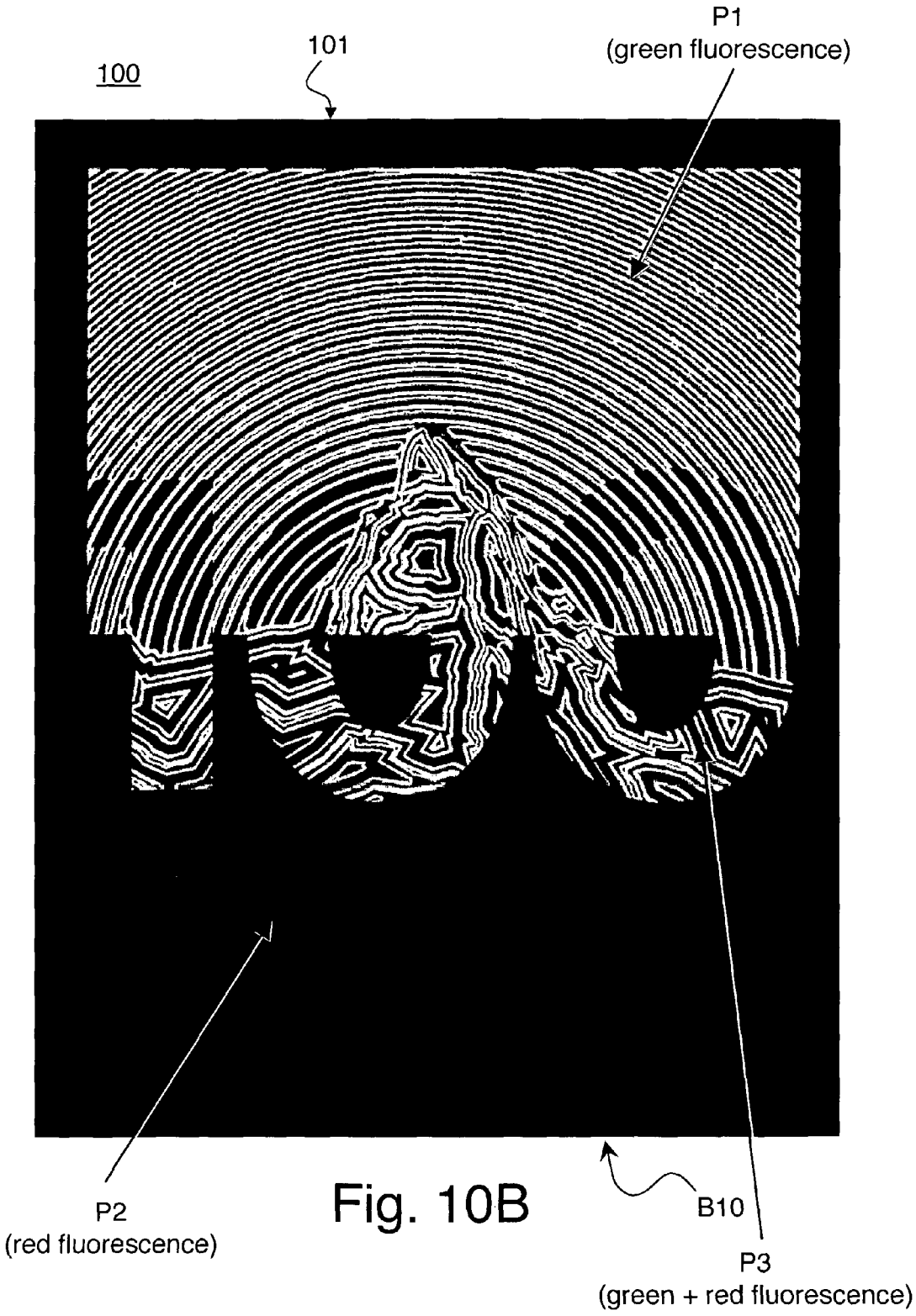
FIG. 10B is a photographic illustration of the printed security feature of FIG. 10A when illuminated with non-visible light, namely ultraviolet light in this example, which reveals the distinctive two-dimensional graphic element that is not visible under visible white light.
Figure 11B:
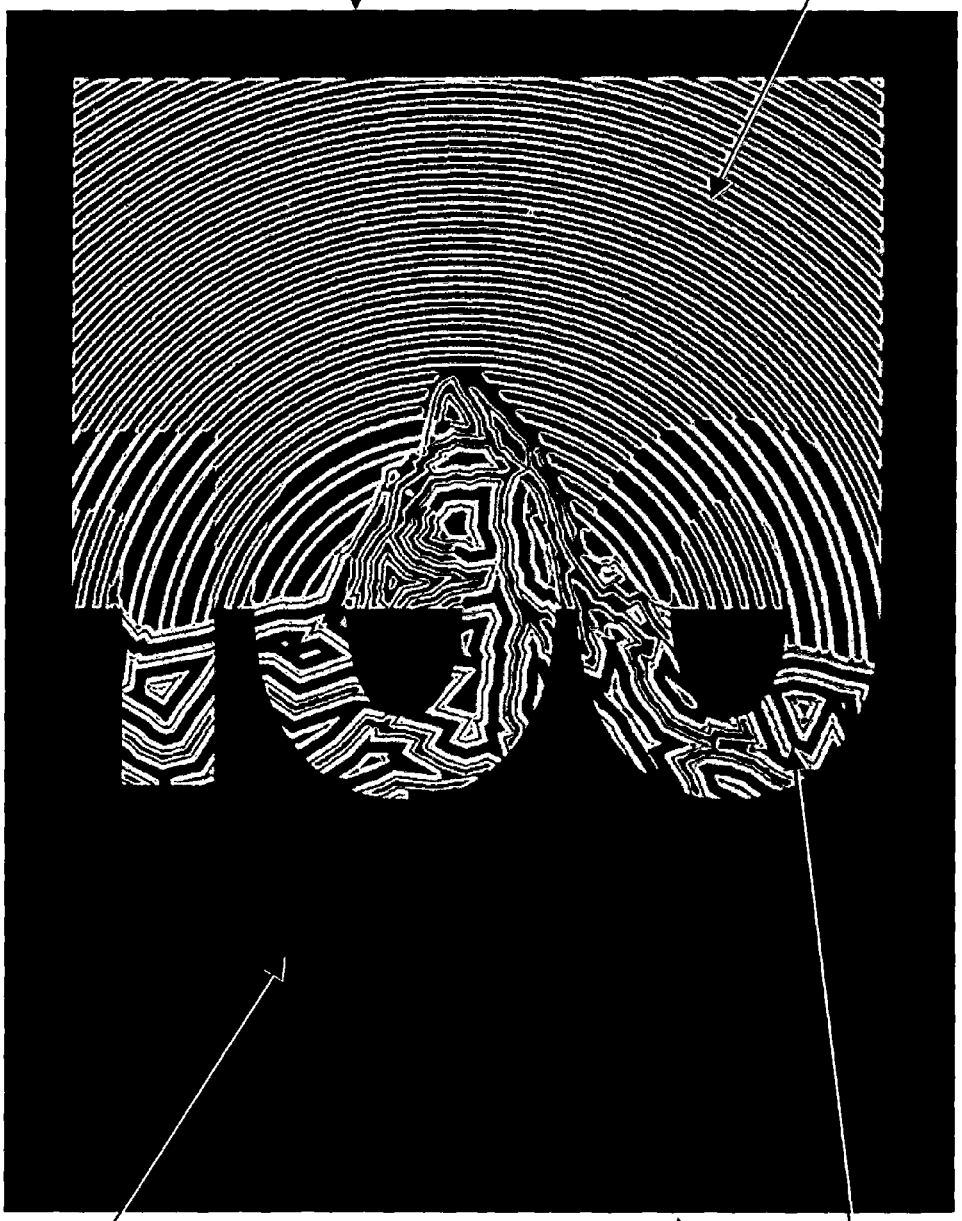
FIG. 11B is a photographic illustration of the printed security feature of FIG. 11A when illuminated with non-visible light, namely ultraviolet light in this example, which reveals the distinctive two-dimensional graphic element that is not visible under visible white light.

FIGS. 9B, 10B and 11B are photographic illustrations of the printed security feature 90, 100, 110, respectively, when illuminated with ultraviolet light, which once again reveals the second graphical representation B9, B10, B11, respectively, and the distinctive two-dimensional graphic element B that is not visible under visible white light. Except for the particular arrangement and distribution of the geometric elements on the printed areas 91, 101, 111 (which differ from that of the previous embodiments), the resulting graphical representation B9, B10, B11 under ultraviolet light is similar to that of the previous embodiments. This being said, the intricate arrangement of the linear elements GE (95-97, 105-107, 115-117) and the particular combination of the first and second inks lead to a particular fluorescent structure in the printed region P3 that is identifiable and provides additional security.

Reference will now be made to an illustrative example of a printed security feature in accordance with a twelfth embodiment of the invention, which twelfth embodiment is a variant of the eighth embodiment shown in FIGS. 8A-B.

According to this twelfth embodiment (not illustrated), the printed security feature includes a printed area consisting of a multiplicity of geometric elements GE. By way of illustration, the multiplicity of geometric elements takes the shape of repetitive elements forming a screen, which repetitive elements are dimensionally-modulated to produce a corresponding halftone image similar to the halftone image A8 of FIG. 8A, which likewise represents the Matterhorn mountain (as in the case of the first and third to eleventh embodiments). The repetitive elements may likewise advantageously be printed with a spatial frequency of 2 to 50 elements per millimetre.

In contrast to the eighth embodiment, the printed area includes, in this illustrative example, a first (lower) section (representing in this case the landscape with the Matterhorn mountain) and a second (upper) section (representing in this case the sky surrounding the Matterhorn mountain). The subdivision into first and second sections is obviously purely illustrative.

In this illustrative example, the first (lower) section (which consists of geometric elements) is printed with the same first and second fluorescent inks as in the other embodiments. The explanations provided hereinabove therefore also apply to the first section which is printed in exactly the same manner as before.

In this illustrative example, the second (upper) section (which consists of geometric elements) is printed with third and fourth fluorescent inks, which exhibit the same or substantially the same optical appearance when illuminated with visible white light, which optical appearance is however different from the optical appearance of the first and second fluorescent inks. In this way, a clear distinction can be made between the first and second printed sections of the printed security feature in accordance with this twelfth embodiment.

The third fluorescent ink however exhibits the same or substantially the same first fluorescent colour as the first fluorescent ink (i.e. a green fluorescent colour in this example). Likewise, the fourth fluorescent ink exhibits the same or substantially the same second fluorescent colour as the second fluorescent ink (i.e. a red fluorescent colour in this example).

The second (upper) section is printed with the third and fourth fluorescent inks while respecting the same basic rules as in the case of the first (lower) section. In this way, when illuminated with non-visible light, the printed security feature in accordance with this twelfth embodiment produces the same (or substantially the same) second graphical representation with the distinctive two-dimensional graphic element B which is revealed only when the printed security feature is illuminated with non-visible light (i.e. the pattern "100" in this example). In that respect, in this illustrative example, the second graphical representation is basically identical to the second graphical representation B8 shown in FIG. 8B.

It will therefore be understood that, in this illustrative example, the upper section is likewise subdivided in at least three printed portions, including first and second printed portions, adjacent to the distinctive two-dimensional graphic element B, and a third printed portion, inside boundaries 200 of the distinctive two-dimensional graphic element B, as again schematically illustrated by FIG. 1C. In this case, in the first printed portion of the upper section, the geometric elements GE are printed with the third ink, namely a green fluorescent ink in the illustrative example. In the second printed portion of the upper section, the geometric elements GE are printed with the fourth ink, namely a red fluorescent ink in the illustrative example. Likewise, in the third printed portion of the upper section (i.e. inside the boundaries 200 of the distinctive two-dimensional element B), the geometric elements GE are subdivided into first and second contiguous portions, the first contiguous portions being printed with the third (green fluorescent) ink and the second contiguous portions being printed with the fourth (red fluorescent) ink. As the first and third fluorescent inks, respectively the second and fourth fluorescent inks, exhibit the same fluorescent colours, the resulting (second) graphical representation that is revealed under non-visible light remains substantially the same as in the embodiment of FIGS. 8A-B.

It will be appreciated that the principle described in relation to the twelfth embodiment is not limited to the particular illustrative example being described and can be applied as soon as one desires to provide the security feature with at least two printed sections with different optical appearances under visible light. This principle can therefore be extended to printed security features having more than two such printed sections and can in particular be applied in the context of any of the other embodiments described herein.

In the aforementioned embodiments, a ratio of a surface of the first contiguous portions GE_a, over a surface of the second contiguous portions GE_b, inside the boundaries 200 of the two-dimensional graphic element B is substantially equal to 1. In other words, in the illustrations of FIGS. 1A-E to 11A-B, the area of each contiguous portion is approximately half (i.e. 50%) that of the area of the corresponding geometric elements GE. This ratio can be changed if required. Preferably this ratio preferably lies within a range of ½ to 2, which provides flexibility to modulate the respective contributions of the first and second fluorescent inks used in the aforementioned preferred embodiments.

In the context of the present invention, it is advantageous to ensure that the effective printed area covered by the geometric elements GE (i.e. the area effectively covered by the inks) is in the range of 30% to 70%, preferably in the range of 40% to 60%, even more preferably close to 50%. In other words, an ink coverage ratio of the printed security feature of the present invention is advantageously in the range of 30% to 70%, preferably in the range of 40% to 60%, and even more preferably close to 50%.

As far as the dimensions of the geometric elements GE and the spatial frequency thereof are concerned, it is preferable to ensure that the geometric elements GE are printed over the printed area with a spatial frequency of the order of 2 to 50 elements per millimetre.

Printing of the geometric elements GE is preferably carried out by Simultan-offset, namely by inking first and second offset printing plates with the first and second inks, respectively, and by transferring resulting first and second ink patterns from the first and second offset printing plates onto a common blanket cylinder prior to printing. Other printing processes could be contemplated (such as intaglio printing) provided the printing process is adapted to print the multiplicity of geometric elements with an adequate register between the first and second inks. A suitable Simultan-offset printing press is for instance disclosed in European Patent Publication No. EP 0 949 069 A1, which is incorporated herein by reference. The aforementioned security features 10, 20, 30, 40, 50, 60, 70, 80, 90, 100, 110 can conveniently be printed on one or the other side of a sheet (or any other suitable substrate) using at least two of the four plate cylinders that cooperate with one or the other blanket cylinder of the main printing group of the printing press of EP 0 949 069 A1 (see FIG. 1 thereof where reference numerals 4 to 7, respectively 8 to 11, designate relevant plate cylinders cooperating with a common blanket cylinder 2, respectively 3). It will be understood that the twelfth embodiment described above could be printed using all four plate cylinders 4-7 or 8-11 cooperating with one or the other blanket cylinder 2 or 3. Alternatively, the aforementioned security features 10, 20, 30, 40, 50, 60, 70, 80, 90, 100, 110 could also be printed on one side of the sheet using the two plate cylinders that cooperate with the blanket cylinder of the additional printing group of the printing press of EP 0 949 069 A1 (see FIG. 1 thereof where reference numerals 23 and 24 designate relevant plate cylinders cooperating with a common blanket cylinder 22).

Various modifications and/or improvements may be made to the above-described embodiments without departing from the scope of the invention as defined by the annexed claims.

As already mentioned, within the scope of the present invention, the printed area can consist of a multiplicity of geometric elements printed with a given distribution over the printed area of the security feature. The invention is not therefore limited to the illustrated examples and other geometric elements could be contemplated without departing from the scope of the invention as defined by the annexed claims.

LIST OF REFERENCE NUMERALS USED THEREIN

B distinctive two-dimensional graphic element (e.g. "100" pattern) which is revealed when the printed security feature 10, 20, 30, 40, 50, 60, 70, 80, 90, 100 or 110 is illuminated with non-visible light (FIGS. 1B, 1C, 2B, 3B, 4B, 5B, 6B, 7B, 8B, 9B, 10B, 11B)

200 boundaries of two-dimensional graphic element B (not visible when illuminated with visible white light)

GE geometric elements forming the printed security feature 10, 20, 30, 40, 50, 60, 70, 80, 90, 100 or 110

GE_a first (contiguous) portion of geometric elements GE, inside the boundaries 200 of the distinctive two-dimensional graphic element B, which is printed with a first (respectively third) ink that is responsive to non-visible light excitation by producing a characteristic optical response/e.g. (first, respectively third) fluorescent ink producing a (first) fluorescent (e.g. green) colour when subjected to the non-visible light excitation (e.g. ultraviolet excitation)

GE_b second (contiguous) portion of geometric elements GE, inside the boundaries 200 of the distinctive two-dimensional graphic element B, which is printed with a second (respectively fourth) ink/e.g. (second, respectively fourth) fluorescent ink producing a (second) fluorescent (e.g. red) colour when subjected to the non-visible light excitation (e.g. ultraviolet excitation)

10 printed security feature (first embodiment—FIGS. 1A to 1E)

11 printed area of printed security feature 10

15 geometric elements forming printed security feature 10

A1 first graphical representation visible when the printed security feature 10 is illuminated with visible white light (FIG. 1A)

B1 second graphical representation which becomes visible when the printed security feature 10 is illuminated with non-visible light (FIG. 1B)

Z1 enlarged portion of printed security feature 10 (FIGS. 1C and 1D)

Z2 enlarged portion of printed security feature 10 (FIGS. 1C and 1E)

20 printed security feature (second embodiment—FIGS. 2A and 2B)

21 printed area of printed security feature 20

25 geometric elements forming printed security feature 20

A2 first graphical representation visible when the printed security feature 20 is illuminated with visible white light (FIG. 2A)

B2 second graphical representation which becomes visible when the printed security feature 20 is illuminated with non-visible light (FIG. 2B)

30 printed security feature (third embodiment—FIGS. 3A and 3B)

31 printed area of printed security feature 30

35 geometric elements forming printed security feature 30

A3 first graphical representation visible when the printed security feature 30 is illuminated with visible white light (FIG. 3A)

B3 second graphical representation which becomes visible when the printed security feature 30 is illuminated with non-visible light (FIG. 3B)

Figure 4A:
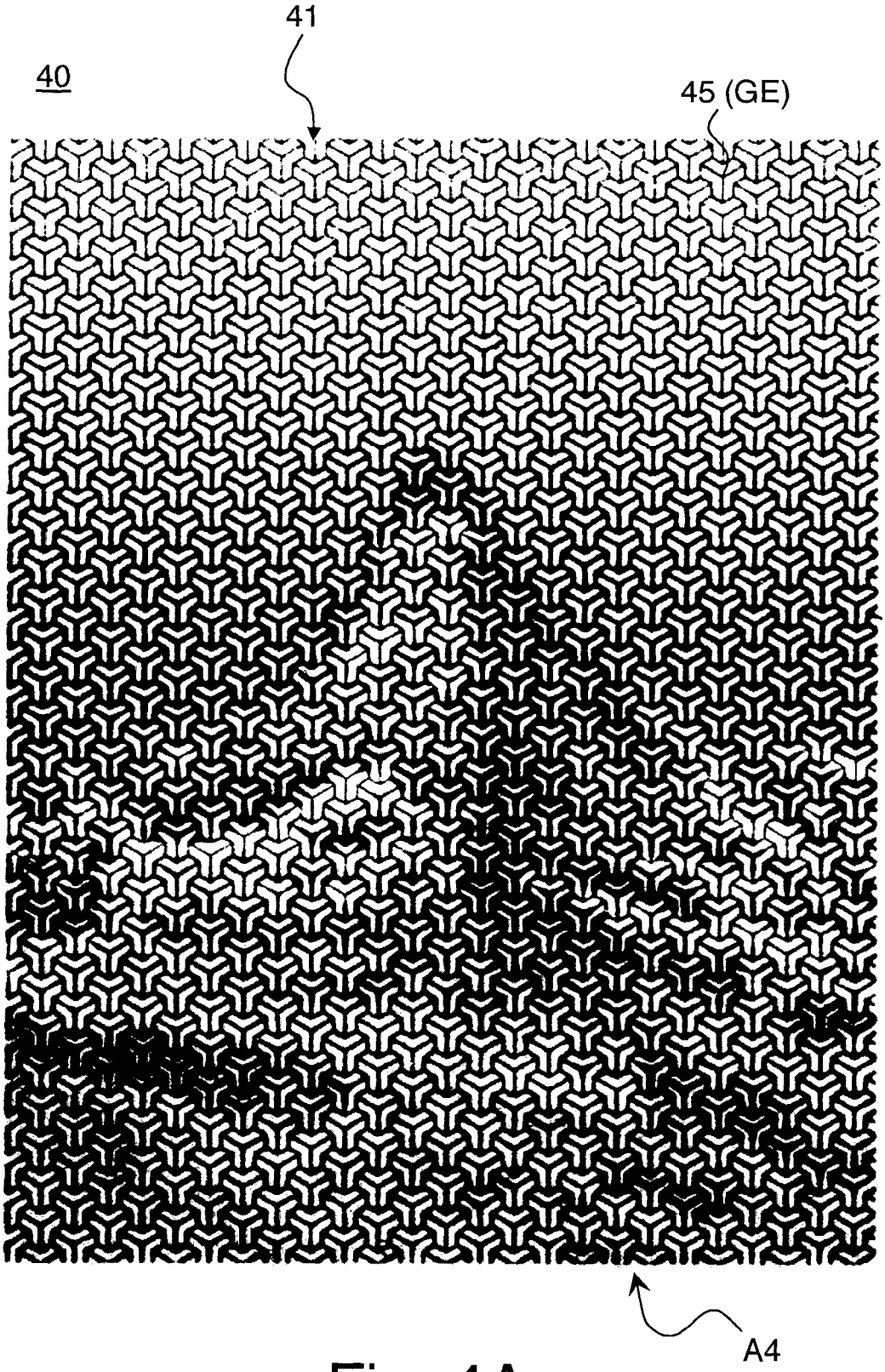
FIG. 4A is a schematic view of a printed security feature in accordance with a fourth embodiment of the invention, FIG. 4A illustrating the printed security feature when illuminated with visible white light.
Figure 4B:
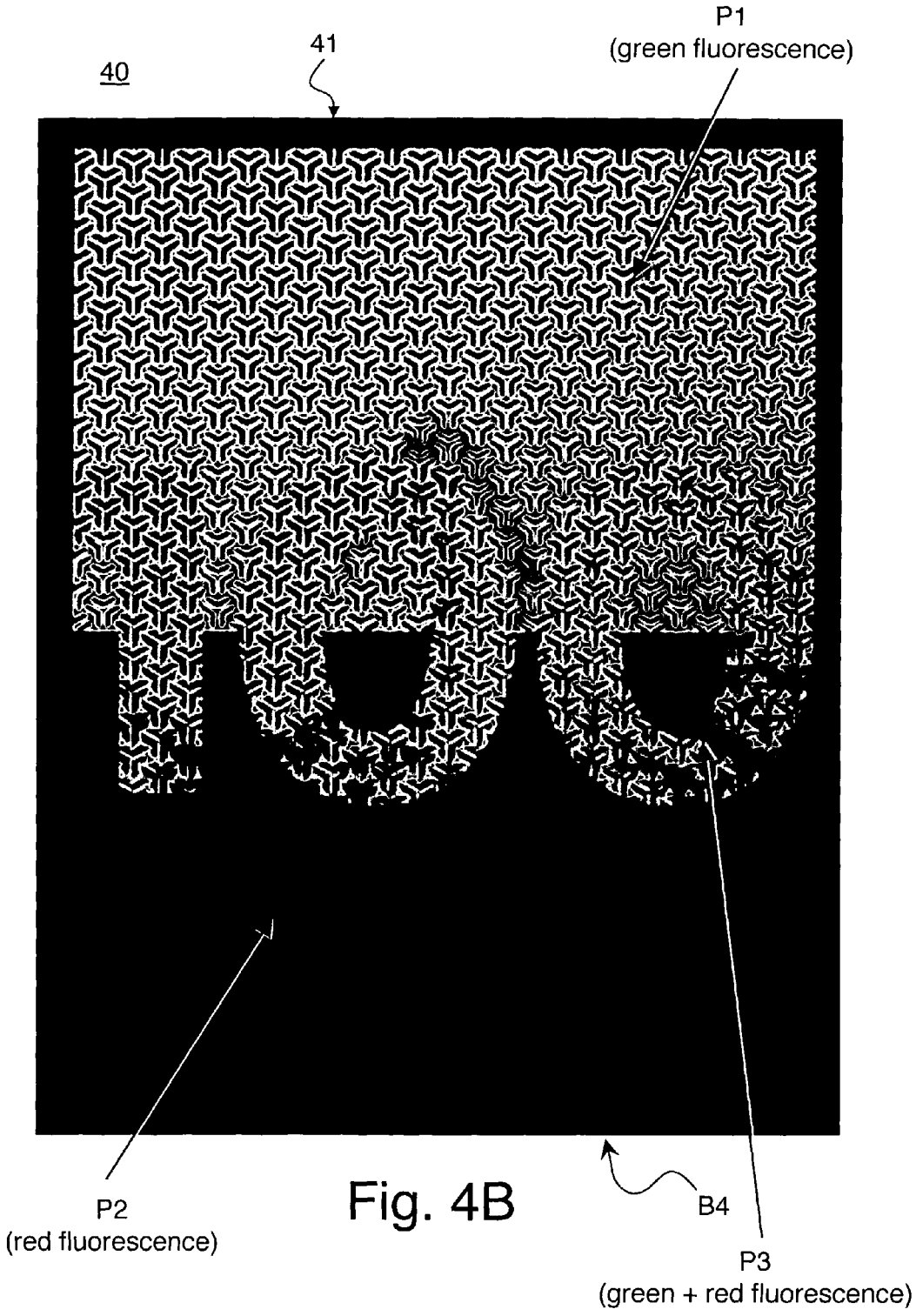
FIG. 4B is a photographic illustration of the printed security feature of FIG. 4A when illuminated with non-visible light, namely ultraviolet light in this example, which reveals the distinctive two-dimensional graphic element that is not visible under visible white light.

40 printed security feature (fourth embodiment—FIGS. 4A and 4B)

41 printed area of printed security feature 40

45 geometric elements forming printed security feature 40

A4 first graphical representation visible when the printed security feature 40 is illuminated with visible white light (FIG. 4A)

B4 second graphical representation which becomes visible when the printed security feature 40 is illuminated with non-visible light (FIG. 4B)

Figure 5A:
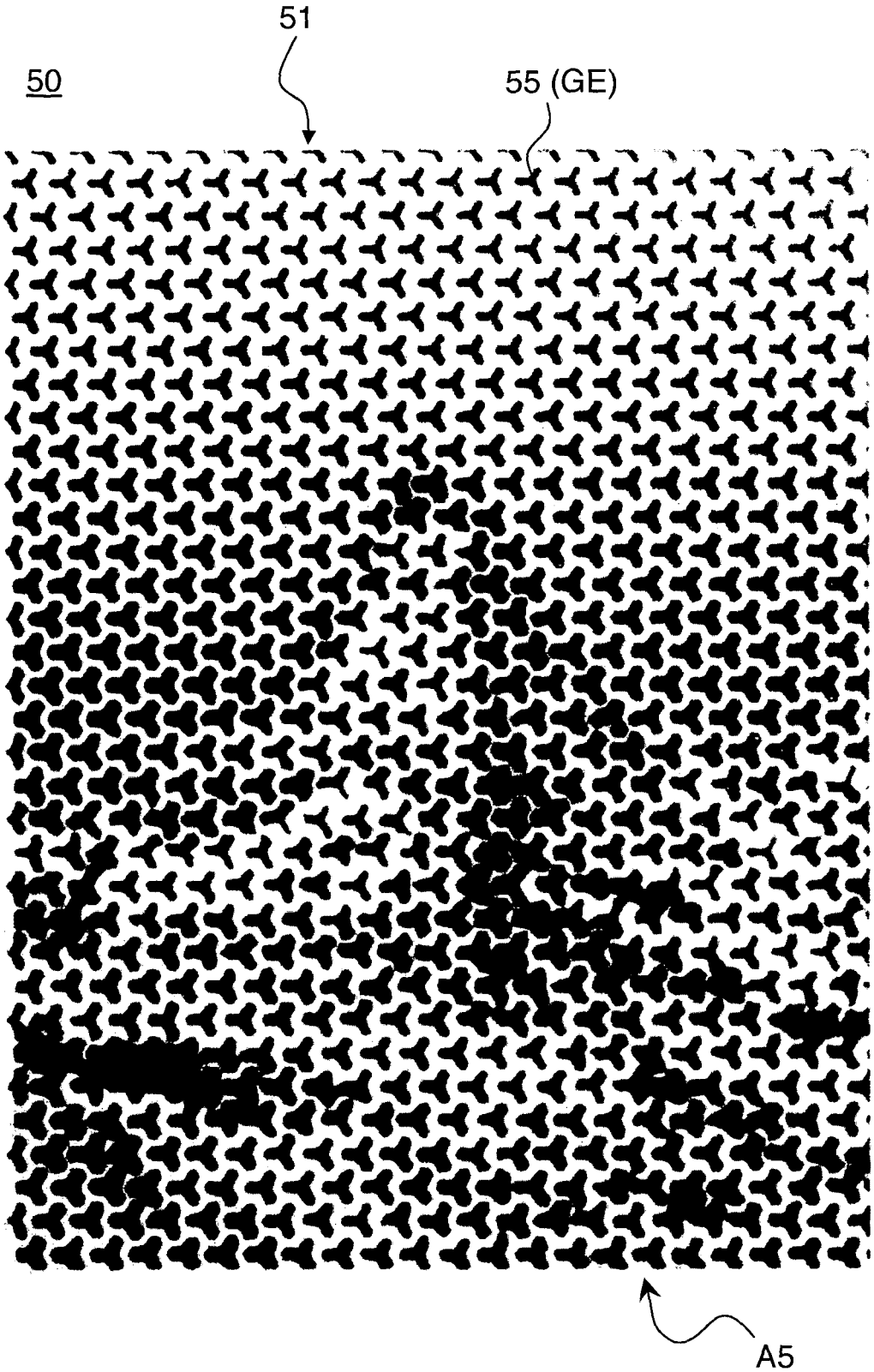
FIG. 5A is a schematic view of a printed security feature in accordance with a fifth embodiment of the invention, FIG. 5A illustrating the printed security feature when illuminated with visible white light.
Figure 5B:
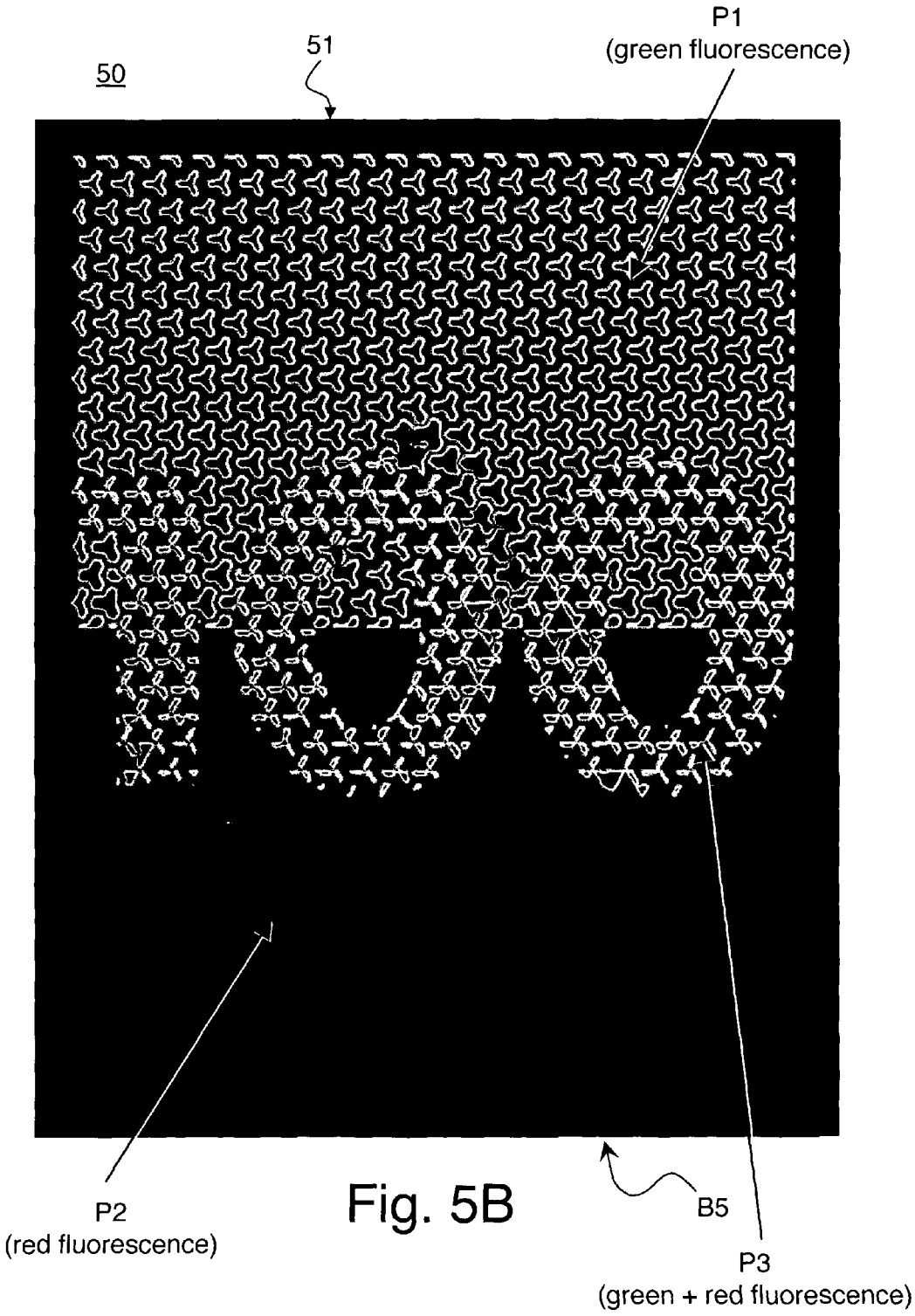
FIG. 5B is a photographic illustration of the printed security feature of FIG. 5A when illuminated with non-visible light, namely ultraviolet light in this example, which reveals the distinctive two-dimensional graphic element that is not visible under visible white light.

50 printed security feature (fifth embodiment—FIGS. 5A and 5B)

51 printed area of printed security feature 50

55 geometric elements forming printed security feature 50

A5 first graphical representation visible when the printed security feature 50 is illuminated with visible white light (FIG. 5A)

B5 second graphical representation which becomes visible when the printed security feature 50 is illuminated with non-visible light (FIG. 5B)

Figure 6A:
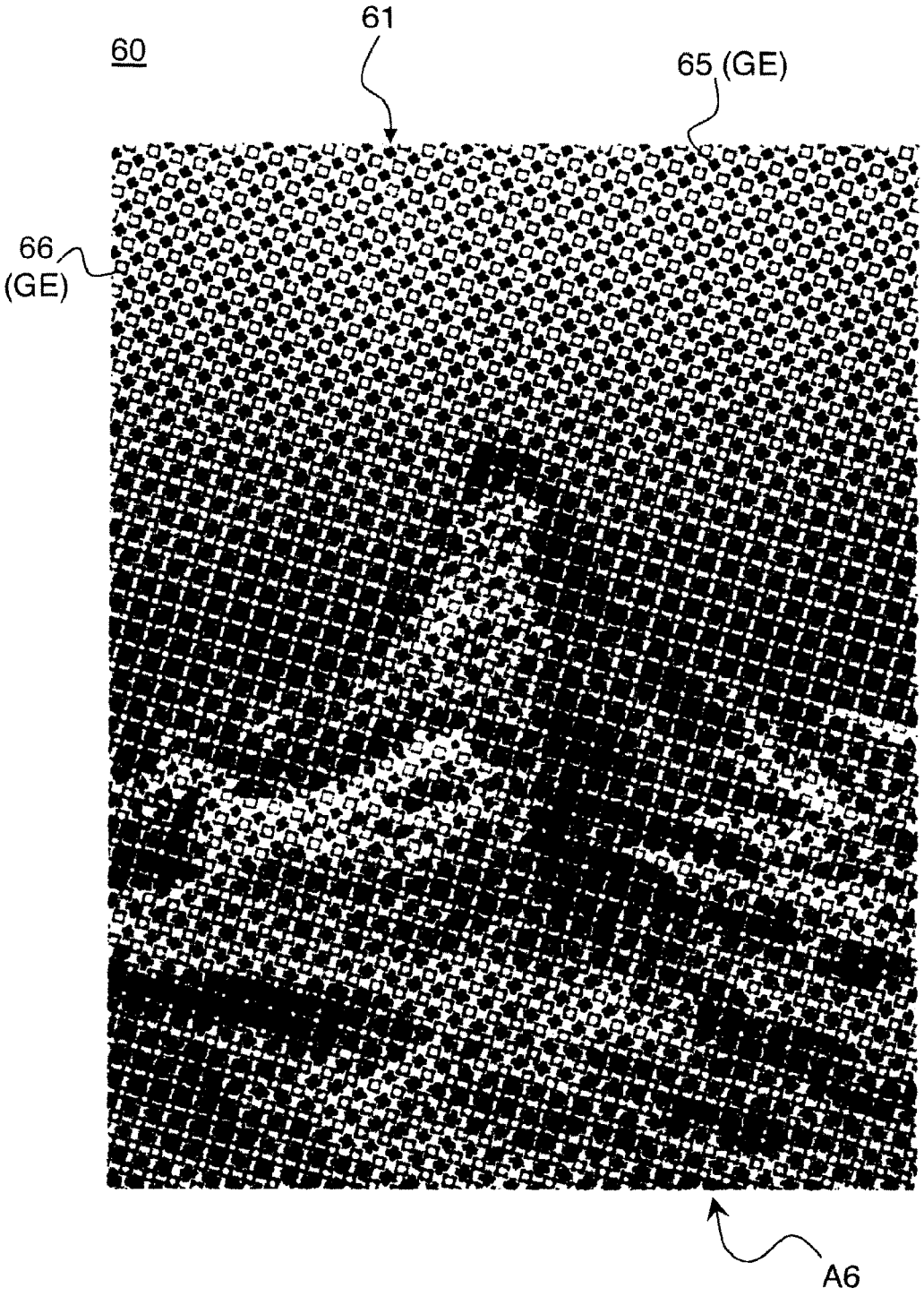
FIG. 6A is a schematic view of a printed security feature in accordance with a sixth embodiment of the invention, FIG. 6A illustrating the printed security feature when illuminated with visible white light.
Figure 6B:
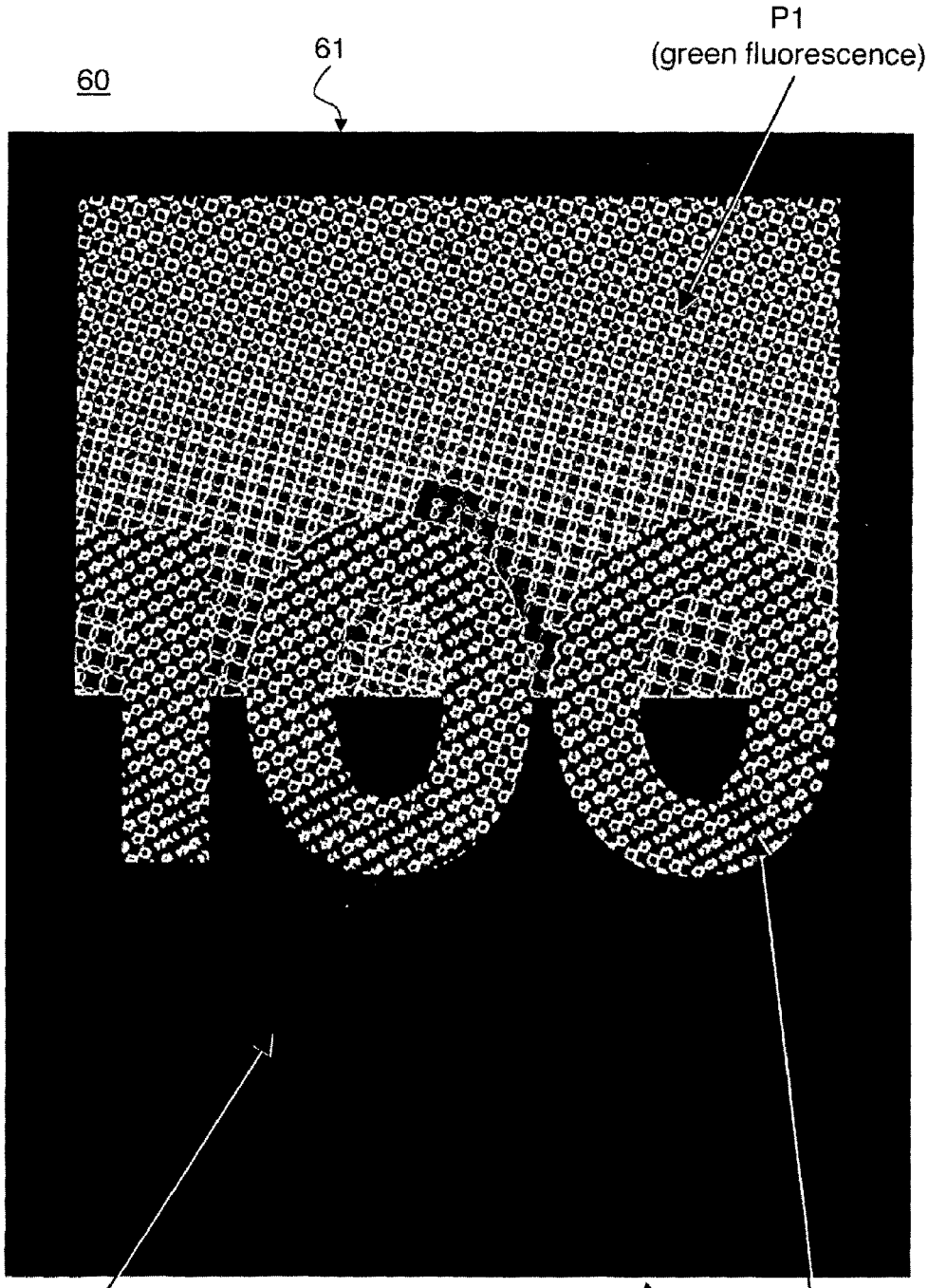
FIG. 6B is a photographic illustration of the printed security feature of FIG. 6A when illuminated with non-visible light, namely ultraviolet light in this example, which reveals the distinctive two-dimensional graphic element that is not visible under visible white light.

60 printed security feature (sixth embodiment—FIGS. 6A and 6B)

61 printed area of printed security feature 60

65-66 (first and second) geometric elements forming printed security feature 60

A6 first graphical representation visible when the printed security feature 60 is illuminated with visible white light (FIG. 6A)

B6 second graphical representation which becomes visible when the printed security feature 60 is illuminated with non-visible light (FIG. 6B)

Figure 7A:
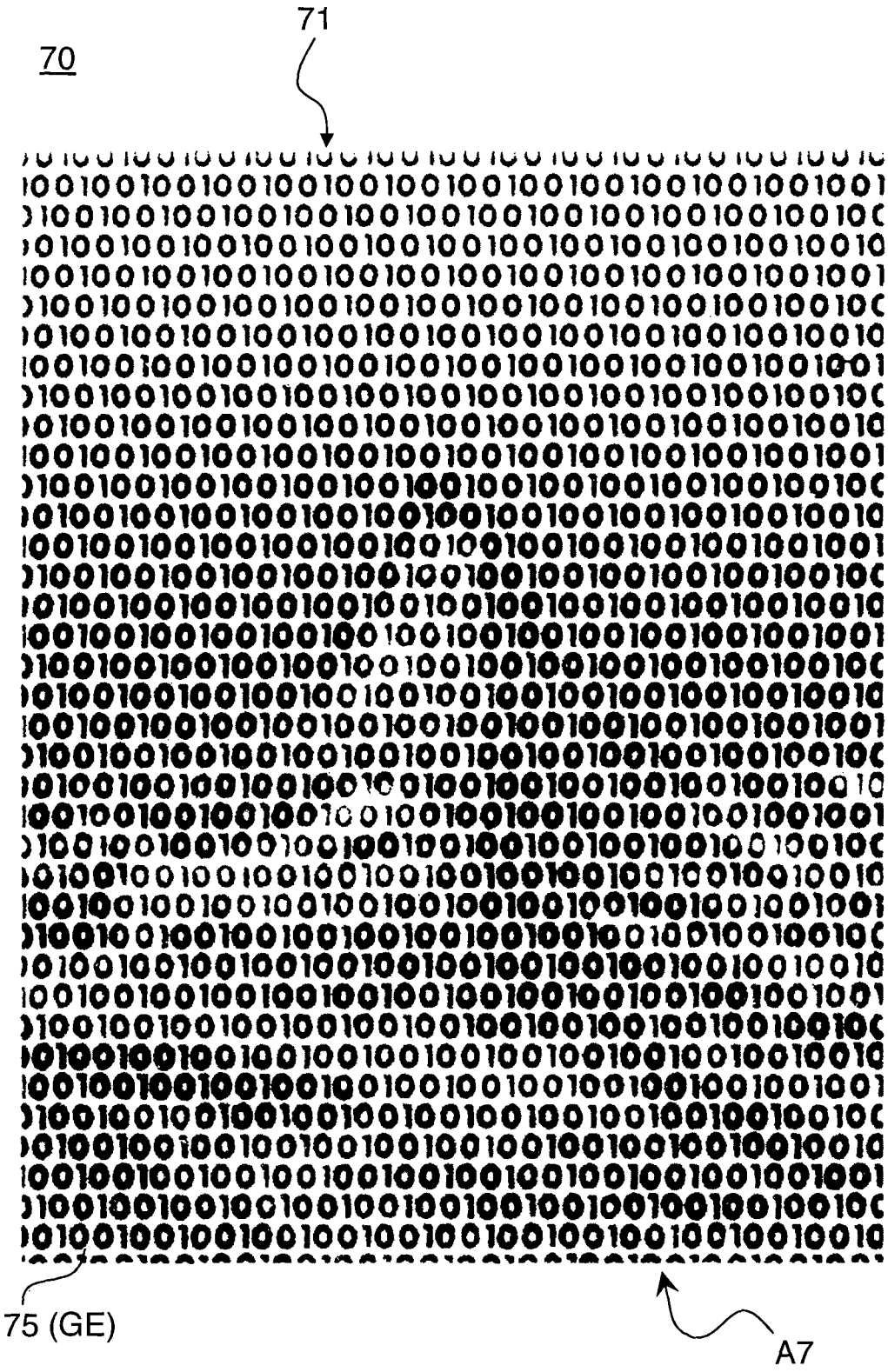
FIG. 7A is a schematic view of a printed security feature in accordance with a seventh embodiment of the invention, FIG. 7A illustrating the printed security feature when illuminated with visible white light.
Figure 7B:
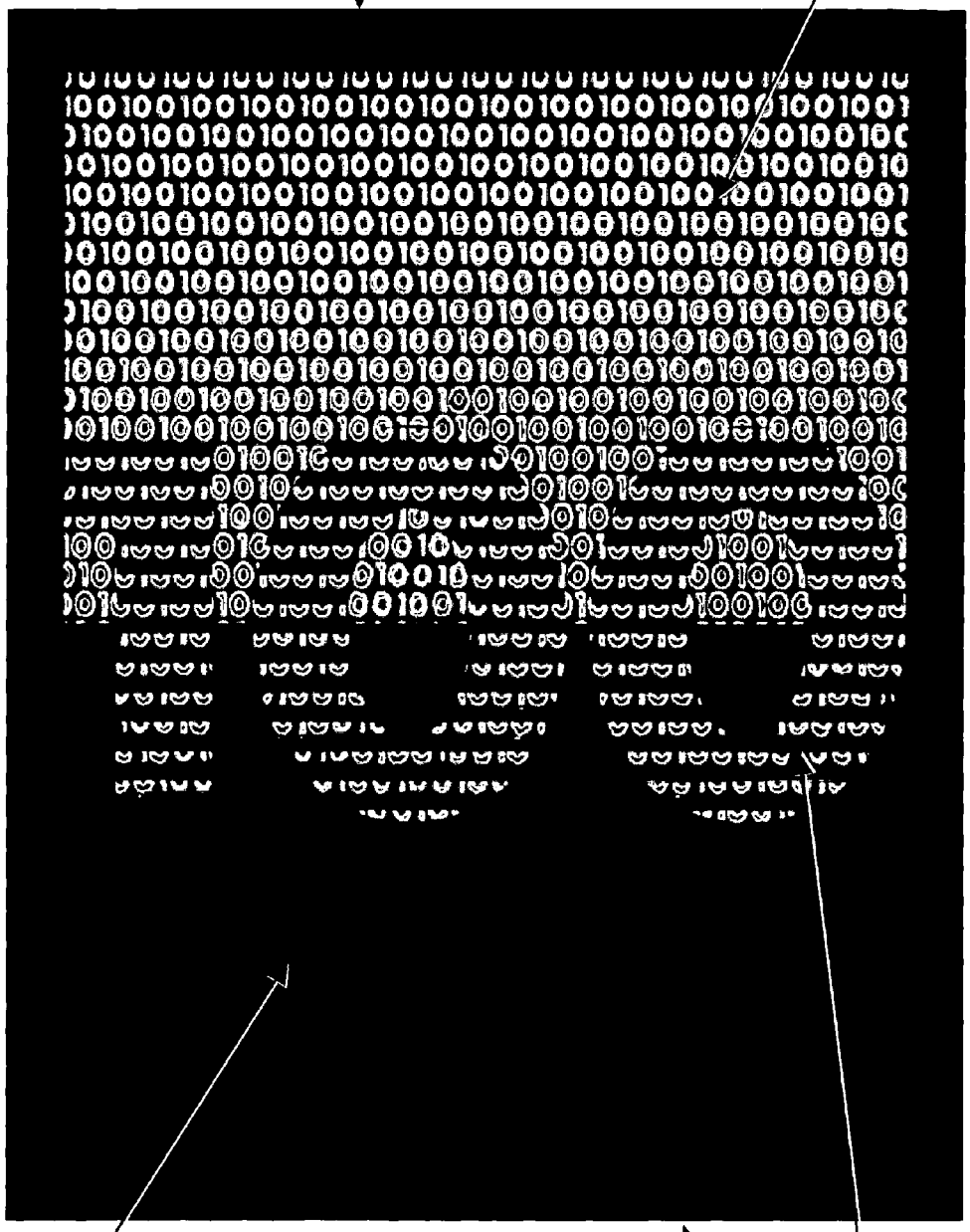
FIG. 7B is a photographic illustration of the printed security feature of FIG. 7A when illuminated with non-visible light, namely ultraviolet light in this example, which reveals the distinctive two-dimensional graphic element that is not visible under visible white light.

70 printed security feature (seventh embodiment—FIGS. 7A and 7B)

71 printed area of printed security feature 70

75 geometric elements forming printed security feature 70

A7 first graphical representation visible when the printed security feature 70 is illuminated with visible white light (FIG. 7A)

B7 second graphical representation which becomes visible when the printed security feature 70 is illuminated with non-visible light (FIG. 7B)

Figure 8A:
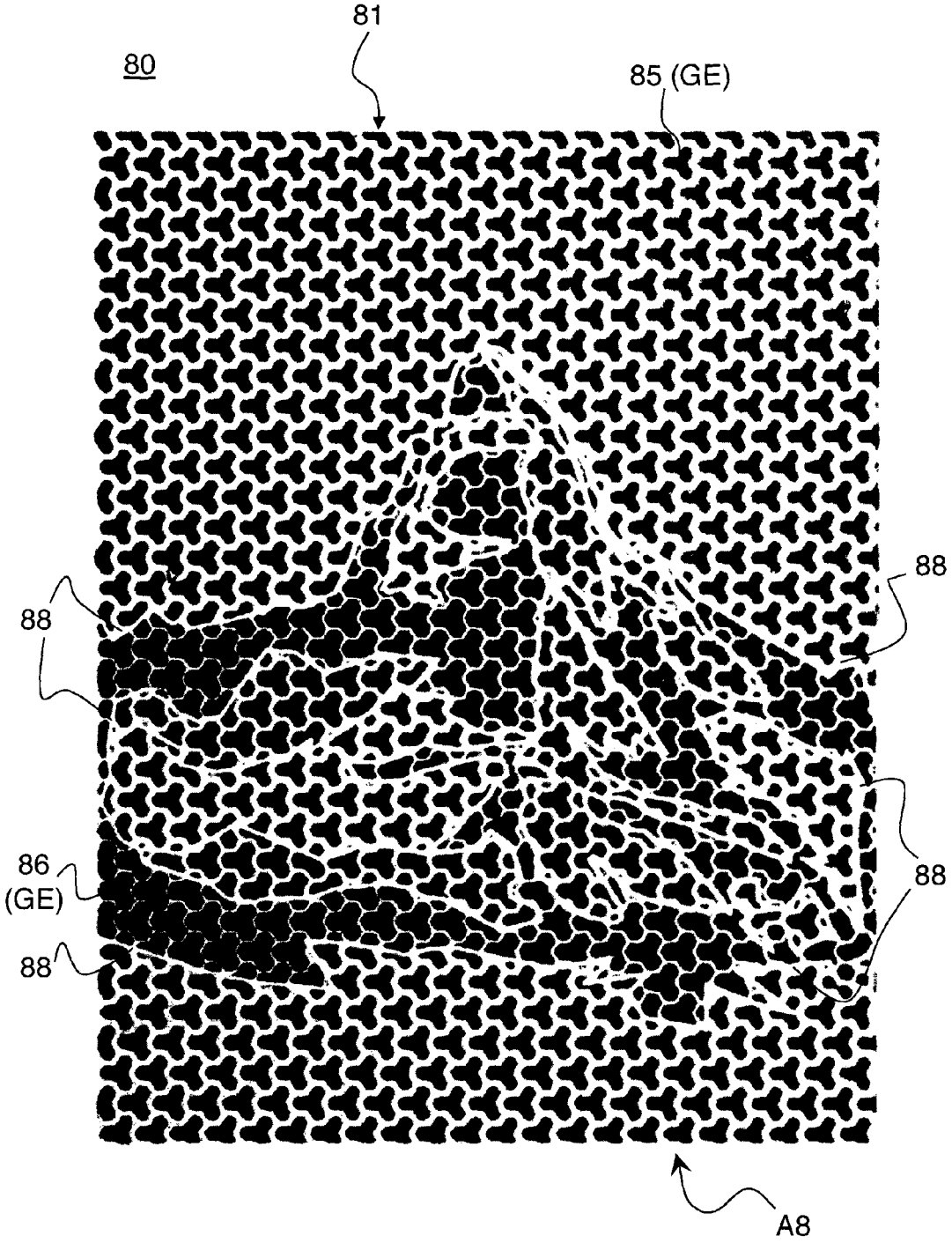
FIG. 8A is a schematic view of a printed security feature in accordance with an eighth embodiment of the invention, FIG. 8A illustrating the printed security feature when illuminated with visible white light.
Figure 8B:
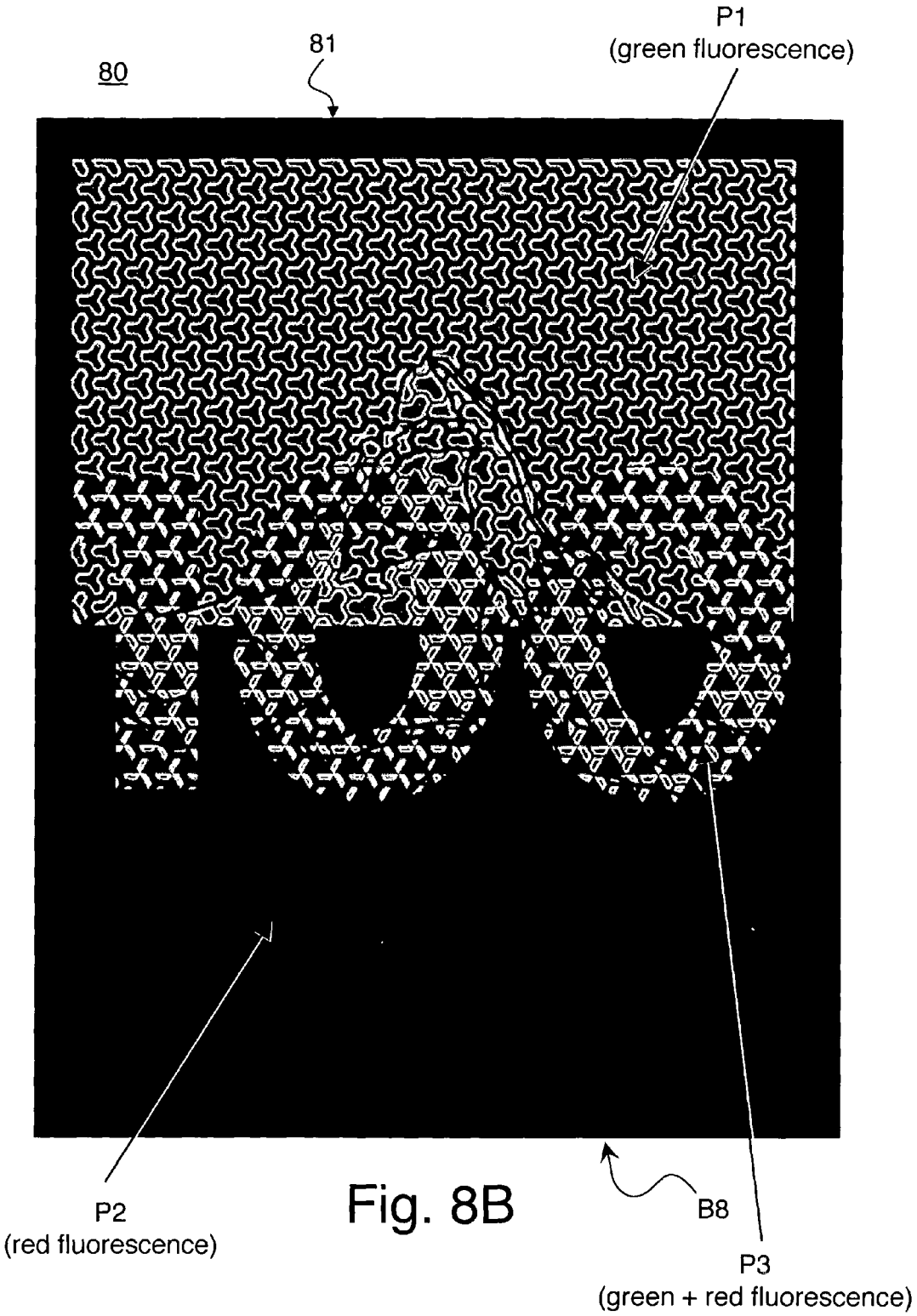
FIG. 8B is a photographic illustration of the printed security feature of FIG. 8A when illuminated with non-visible light, namely ultraviolet light in this example, which reveals the distinctive two-dimensional graphic element that is not visible under visible white light.

80 printed security feature (eighth embodiment—FIGS. 8A and 8B)

81 printed area of printed security feature 80

85-86 (first and second) geometric elements forming printed security feature 80

88 unprinted separation line between first and second geometric elements 85-86

A8 first graphical representation visible when the printed security feature 80 is illuminated with visible white light (FIG. 8A)

B8 second graphical representation which becomes visible when the printed security feature 80 is illuminated with non-visible light (FIG. 8B)

90 printed security feature (ninth embodiment—FIGS. 9A and 9B)

91 printed area of printed security feature 90

95-97 geometric elements forming printed security feature 90

A9 first graphical representation visible when the printed security feature 90 is illuminated with visible white light (FIG. 9A)

B9 second graphical representation which becomes visible when the printed security feature 90 is illuminated with non-visible light (FIG. 9B)

100 printed security feature (tenth embodiment—FIGS. 10A and 10B)

101 printed area of printed security feature 100

105-107 geometric elements forming printed security feature 100

A10 first graphical representation visible when the printed security feature 100 is illuminated with visible white light (FIG. 10A)

B10 second graphical representation which becomes visible when the printed security feature 100 is illuminated with non-visible light (FIG. 10B)

110 printed security feature (eleventh embodiment—FIGS. 11A and 11B)

111 printed area of printed security feature 110

115-117 geometric elements forming printed security feature 110

A11 first graphical representation visible when the printed security feature 110 is illuminated with visible white light (FIG. 11A)

B11 second graphical representation which becomes visible when the printed security feature 110 is illuminated with non-visible light (FIG. 11B)

P1 (first) printed portion of relevant section of printed area 11, 21, 31, 41, 51, 61, 71, 81, 91, 101, 111 adjacent to the distinctive two-dimensional graphic element B, which consists of geometric elements that are printed with only the first (respectively third) ink P2 (second) printed portion of relevant section of printed area 11, 21, 31, 41, 51, 61, 71, 81, 91, 101, 111 adjacent to the distinctive two-dimensional graphic element B, which consists of geometric elements that are printed with only the second (respectively fourth) ink P3 (third) printed portion of relevant section of printed area 11, 21, 31, 41, 51, 61, 71, 81, 91, 101, 111 inside the boundaries 200 of the distinctive two-dimensional graphic element B, which consists of geometric elements that are subdivided into the first contiguous portions GE_a printed with the first (respectively third) ink and the second contiguous portions GE_b printed with the second (respectively fourth) ink

The invention claimed is:

1. A printed security feature provided onto a printable substrate, which printed security feature includes a printed area with at least a first printed section consisting of a multiplicity of geometric elements printed with a given distribution over the printed area, wherein the geometric elements are printed with at least first and second inks which exhibit the same or substantially the same optical appearance when illuminated with visible white light, such that the printed security feature produces a first graphical representation when illuminated with visible white light, at least the first ink being an ink which responds to non-visible light excitation by producing a characteristic optical response differentiating the first ink from the second ink, wherein the printed security feature produces a second graphical representation when illuminated with non-visible light, which second graphical representation exhibits a distinctive two-dimensional graphic element which is revealed only when the printed security feature is illuminated with non-visible light, wherein the first printed section is subdivided into at least three printed portions including first and second printed portions, adjacent to the distinctive two-dimensional graphic element, and a third printed portion, inside boundaries of the distinctive two-dimensional graphic element, wherein, in the first printed portion, the geometric elements are printed with the first ink, wherein, in the second printed portion, the geometric elements are printed with the second ink, and wherein, in the third printed portion, the geometric elements are subdivided into first and second contiguous portions, the first contiguous portions being printed with the first ink and the second contiguous portions being printed with the second ink, the first and second inks being printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

2. The printed security feature according to claim 1, wherein the printed area includes, in addition to the first printed section, at least a second printed section consisting of a multiplicity of geometric elements printed with a given distribution over the printed area, wherein the geometric elements of the second printed section are printed with at least third and fourth inks which exhibit the same or substantially the same optical appearance when illuminated with visible white light, which optical appearance of the third and fourth inks is different from the optical appearance of the first and second inks, wherein at least the third ink is an ink which responds to non-visible light excitation by producing a characteristic optical response differentiating the third ink from the fourth ink, which characteristic optical response of the third ink is the same or substantially the same as the characteristic optical response of the first ink, wherein the first graphical representation and the second graphical representation are formed jointly by the first and second printed sections, wherein the second printed section is subdivided into at least three printed portions including first and second printed portions, adjacent to the distinctive two-dimensional graphic element, and a third printed portion, inside the boundaries of the distinctive two-dimensional graphic element, wherein, in the first printed portion of the second printed section, the geometric elements are printed with the third ink, wherein, in the second printed portion of the second printed section, the geometric elements are printed with the fourth ink, and wherein, in the third printed portion of the second printed section, the geometric elements are subdivided into first and second contiguous portions, the first contiguous portions being printed with the third ink and the second contiguous portions being printed with the fourth ink, the third and fourth inks being printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

3. The printed security feature according to claim 2, wherein the first ink is a first fluorescent ink which produces a visible response having a first fluorescent colour when subjected to the non-visible light excitation, wherein the first fluorescent colour contributes to making the distinctive two-dimensional graphic element visible when the printed security feature is subjected to the non-visible light excitation, and wherein the third ink is a fluorescent ink which produces a visible response having the same or substantially the same first fluorescent colour as the first fluorescent ink when subjected to the non-visible light excitation.

4. The printed security feature according to claim 3, wherein the second ink is a second fluorescent ink which produces a visible response having a second fluorescent colour when subjected to the non-visible light excitation, which second fluorescent colour is distinct from the first fluorescent colour, and wherein the fourth ink is a fluorescent ink which produces a visible response having the same or substantially the same second fluorescent colour as the second fluorescent ink when subjected to the non-visible light excitation.

5. The printed security feature according to claim 4, wherein, inside the boundaries of the distinctive two-dimensional graphic element, the first and second contiguous portions produce, when subjected to the non-visible light excitation, a third fluorescent colour resulting from additive mixture of the first and second fluorescent colours.

6. The printed security feature according to claim 1, wherein the geometric elements are linear elements, such as rectilinear and curvilinear elements.

7. The printed security feature according to claim 6, wherein a line width and/or spacing of the linear elements is modulated to produce a halftone image.

8. The printed security feature according to claim 1, wherein the geometric elements are repetitive elements forming a screen.

9. The printed security feature according to claim 8, wherein the repetitive elements are dimensionally-modulated to produce a halftone image.

10. The printed security feature according to claim 8, wherein the geometric elements include a juxtaposition of at least first and second distinctive geometric elements.

11. The printed security feature according to claim 10, wherein the first and second distinctive geometric elements are separated by an unprinted separation line.

12. The printed security feature according to claim 1, wherein the geometric elements are printed with a spatial frequency of 2 to 50 elements per millimetre.

13. The printed security feature according to claim 1, wherein an ink coverage ratio of the printed security feature is in the range of 30% to 70%, preferably in the range of 40% to 60%, and even more preferably close to 50%.

14. The printed security feature according to claim 1, wherein the first ink is a first fluorescent ink which produces a visible response having a first fluorescent colour when subjected to the non-visible light excitation, and wherein the first fluorescent colour contributes to making the distinctive two-dimensional graphic element visible when the printed security feature is subjected to the non-visible light excitation.

15. The printed security feature according to claim 14, wherein the non-visible light excitation is an ultraviolet excitation.

16. The printed security feature according to claim 14, wherein the second ink is a second fluorescent ink which produces a visible response having a second fluorescent colour when subjected to the non-visible light excitation, which second fluorescent colour is distinct from the first fluorescent colour.

17. The printed security feature according to claim 16, wherein, inside the boundaries of the distinctive two-dimensional graphic element, the first and second contiguous portions produce, when subjected to the non-visible light excitation, a third fluorescent colour resulting from additive mixture of the first and second fluorescent colours.

18. The printed security feature according to claim 3, wherein the non-visible light excitation is an ultraviolet excitation.

19. The printed security feature according to claim 1, wherein a ratio of a surface of the first contiguous portions over a surface of the second contiguous portions, inside the boundaries of the distinctive two-dimensional graphic element, lies within a range of ½ to 2.

20. The printed security feature according to claim 1, wherein, inside the boundaries of the distinctive two-dimensional graphic element, the first and second contiguous portions produce, when subjected to the non-visible light excitation, a structure comprising geometric patterns having a distinctive shape that is different from a shape of the geometric elements.

21. An object comprising a substrate and a printed security feature in accordance with claim 1, which printed security feature is provided onto the substrate.

22. The object according to claim 21, wherein the printed security feature is provided on a portion of the substrate which absorbs a substantial part of the non-visible light excitation.

23. The object according to claim 21, wherein the object is a value document, in particular a high security document such as a banknote, or a security element, in particular a foil element, that is applicable onto an article to be protected against forgery.

24. A process of producing an object comprising a substrate and a printed security feature, wherein the process includes:

providing a printable substrate; and printing the security feature in accordance with claim 1 onto the substrate.

25. The process according to claim 24, wherein the multiplicity of geometric elements of the printed security feature is printed by Simultan-offset, namely by inking first and second offset printing plates with the first and second inks, respectively, and by transferring resulting first and second ink patterns from the first and second offset printing plates onto a common blanket cylinder prior to printing.

26. A process of producing an object comprising a substrate and a printed security feature, wherein the process includes:

providing a printable substrate; and printing the security feature in accordance with claim 2 onto the substrate, wherein the multiplicity of geometric elements of the printed security feature is printed by Simultan-offset, namely by inking first and second offset printing plates with the first and second inks, respectively, and by transferring resulting first and second ink patterns from the first and second offset printing plates onto a common blanket cylinder prior to printing, and wherein the multiplicity of geometric elements of the second printed section is also printed by Simultan-offset, by further inking third and fourth offset printing plates with the third and fourth inks, respectively, and by transferring resulting third and fourth ink patterns from the third and fourth offset printing plates onto the common blanket cylinder prior to printing.

* * * * *